US006072972A

United States Patent [19]

Obu et al.

[11] Patent Number: 6,072,972

[45] **Date of Patent: *Jun. 6, 2000**

[54] IMAGE FORMING APPARATUS HAVING LIQUID DEVELOPING DEVICE FOR FORMING COMPACT DEVELOPING LAYER

[75] Inventors: Makoto Obu; Takeo Tsukamoto, both of Kanagawa, Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/946,003

[22] Filed: Oct. 7, 1997

[30] Foreign Application Priority Data

| | | | |
|---|---|---|---|
| Oct. 7, 1996 | [JP] | Japan | 8-284708 |
| Apr. 8, 1997 | [JP] | Japan | 9-106685 |
| Jun. 12, 1997 | [JP] | Japan | 9-173300 |

[51] Int. Cl.[7] ..... G03G 15/10

[52] U.S. Cl. ..... 399/237; 399/249

[58] Field of Search ..... 399/237, 239, 399/240, 241, 249; 430/117, 118, 119

[56] References Cited

U.S. PATENT DOCUMENTS

| | | | |
|---|---|---|---|
| 3,776,723 | 12/1973 | Royka et al. | 430/102 |
| 4,021,586 | 5/1977 | Matkan | 430/117 |
| 4,327,664 | 5/1982 | Ohkawa et al. | 399/240 |
| 4,582,774 | 4/1986 | Landa | 430/126 |
| 4,686,936 | 8/1987 | Chow | 399/239 |
| 4,707,112 | 11/1987 | Hartmann | 399/241 |
| 5,666,616 | 9/1997 | Yoshino et al. . | |
| 5,708,938 | 1/1998 | Takeuchi et al. . | |
| 5,738,967 | 4/1998 | Horii et al. | 430/119 |
| 5,826,149 | 10/1998 | Horii et al. | 399/240 |

*Primary Examiner*—Robert Beatty

*Attorney, Agent, or Firm*—Oblon, Spivak, McClelland, Maier & Neustadt, P.C.

[57] ABSTRACT

In an image forming apparatus having a liquid developing device, a thin layer of dense and viscous developing liquid is formed on a developer carrier and brought into contact with a latent image electrostatically formed on the surface of an image carrier in order to develop it. A preselected electric field is formed between the developer carrier and a device for regulating the thickness of the above layer, providing a dense layer with a uniform high toner content and an excess liquid surface layer. The excess liquid surface layer, formed with the developing liquid layer, is removed by a developing layer removing device. With this configuration, the apparatus ensures images free from irregularity.

51 Claims, 16 Drawing Sheets

IMAGE FORMING APPARATUS HAVING LIQUID DEVELOPING DEVICE FOR FORMING COMPACT DEVELOPING LAYER

BACKGROUND OF THE INVENTION

1. Field of the Invention

The present invention relates to a copier, facsimile apparatus, printer or similar electrophotographic image forming apparatus. More particularly, the present invention is concerned with in image forming apparatus of the type forming a thin layer of dense and viscous developing liquid on a developer carrier and causing it to contact the surface of an image carrier in order to develop a latent image formed thereon by electrophotography, electrostatic recording or ion flow scheme, and a wet developing method for the same.

2. Discussion of the Background

An image forming apparatus with a wet developing device for developing a latent image electrostatically formed on a photoconductive element or similar image carrier is conventional. To reduce the overall size of the image forming apparatus, the size of the wet developing device may be reduced by using, e.g., a dense and viscous developing liquid consisting of an insulating liquid and toner dispersed therein and having a high toner content. Japanese Patent Laid-Open Publication 7-209922, for example, teaches a method of developing a latent image formed on an image carrier with charged toner particles. In accordance with this method, a developing liquid consisting of an insulating liquid and toner dispersed therein and having a viscosity as high as 100 mPa.s to 10,000 mPa.s is applied to a conductive developer carrier and then brought into contact with the image carrier. As a result, the developing liquid is fed to the latent image formed on the image carrier.

The above document also teaches that a prewetting liquid is applied to the image carrier before the development of the latent image. The presetting liquid is an insulating liquid having a parting ability and chemically inactive. The prewetting liquid forms a layer separating the layer of developing liquid fed to the image carrier and the surface of the image carrier. This prevents needless toner from depositing on the surface of the image carrier and thereby protects an image from disturbance ascribable to toner deposition on a non-image area.

The document further teaches that at least one of the image carrier or photoconductive element and developer carrier is formed of an elastic material so as to scatter a contact pressure to act between the developer layer formed on the developer carrier and the photoconductive element. With this configuration, when the developer layer formed on the developer carrier and the photoconductive element contact each other, the developer layer is prevented from being crushed and disturbing the image.

The document additionally teaches that the developer layer formed on the developer carrier has its thickness physically reduced by a series of contact rollers. This kind of thinning method is similar to a method of feeding a thin film of ink to a master in, e.g., an offset printer.

However, the physical scheme for thinning the dense and viscous developing liquid on the developer carrier needs several to several tens of rollers, resulting in a complicated structure and difficult maintenance. Specifically, if the number of rollers is reduced in order to simplify the roller arrangement, then the developer forms ribs on the developer carrier due to the high viscosity of the developer. This makes it difficult to form a thin uniform developer layer on the developer carrier. Consequently, irregularity occurs in the amount of developer to be fed to the photoconductive element and prevents an image from being uniformly developed. The resulting image has an irregular density distribution.

By contrast, an offset printer forming a thin film of ink by a method similar to the above method is free from the irregular image density distribution. This is presumably because the developing liquid for use in the wet developing device contains charged toner particles and therefore differs in electrical characteristic from the ink of the offset printer.

SUMMARY OF THE INVENTION

It is therefore an object of the present invention to provide a simple image forming apparatus capable of depositing a developing liquid on a developer carrier in the from of a uniform dense developer layer and thereby forming an attractive image free from irregularity, and a wet developing device for the same.

In accordance with the present invention, an image forming apparatus for developing a latent image electrostatically formed on an image carrier by feeding a developing liquid having a high toner content to the latent image includes a developer carrier for carrying the developing liquid thereon. A developer regulating device faces, but is spaced from, the developer carrier for causing the developing liquid to form a thin developer layer on the developer carrier. An electric field is formed between the developer carrier and the developer regulating device for causing toner particles of the developing liquid fed to a gap between the developer carrier and the developer regulating device to migrate toward the surface of the developer carrier due to electrophoresis.

Also, in accordance with the present invention, in an image forming apparatus for depositing a dense developing liquid on a developer carrier in the form of a thin developer layer, and causing the developer layer to contact the surface of an image carrier to thereby develop a latent image electrostatically formed on the surface, toner particles contained in the developer layer are caused to cohere after the developer layer has been formed on the developer carrier, but before the developer layer contacts the image carrier.

Further, in accordance with the present invention, a wet developing device includes a reservoir storing a developing liquid consisting at least of a carrier liquid and toner. A developing member is formed with a number of lugs contacting the surface of an image carrier on the circumferential surface thereof. The developing member is rotatable to feed the developing liquid from the reservoir to a latent image electrostatically formed on the image carrier by retaining the developing liquid between the lugs. A regulating member contacts the surface of the developing member for regulating the amount of deposition of the developing liquid retained between the lugs. A liquid replenishing device replenishes one of the developing liquid, the carrier liquid and a liquid similar to the carrier liquid to a developing position where the image carrier and developing member face each other over a preselected width.

Moreover, in accordance with the present invention, a wet developing device includes a reservoir storing a developing liquid consisting at least of a carrier liquid and toner. A developing member is formed with a number of lugs contacting the surface of an image carrier on the circumferential surface thereof. The developing member is rotatable to feed the developing liquid from the reservoir to a latent image electrostatically formed on the image carrier by retaining the developing liquid between the lugs. A voltage applying device applies between the image carrier and the developing member a voltage sufficient for the developing liquid retained between the lugs to contact the image carrier.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Preferred embodiments of the present invention to be described each is implemented as an electrophotographic copier by way of example.

Embodiments to be described first each is implemented as a copier of the type feeding a dense developing liquid from a developer carrier to an image carrier in order to develop a latent image formed on the image carrier. The copier includes developer regulating means facing, but spaced from, the developer carrier for forming a thin developer layer of high toner content on the developer carrier. An electric field is formed between the developer carrier and the developer regulating means such that toner particles contained in the developing liquid fed to a gap between the developer carrier and the developer regulating means migrate toward the surface of the developer carrier due to electrophoresis.

1st Embodiment

Figure 1:
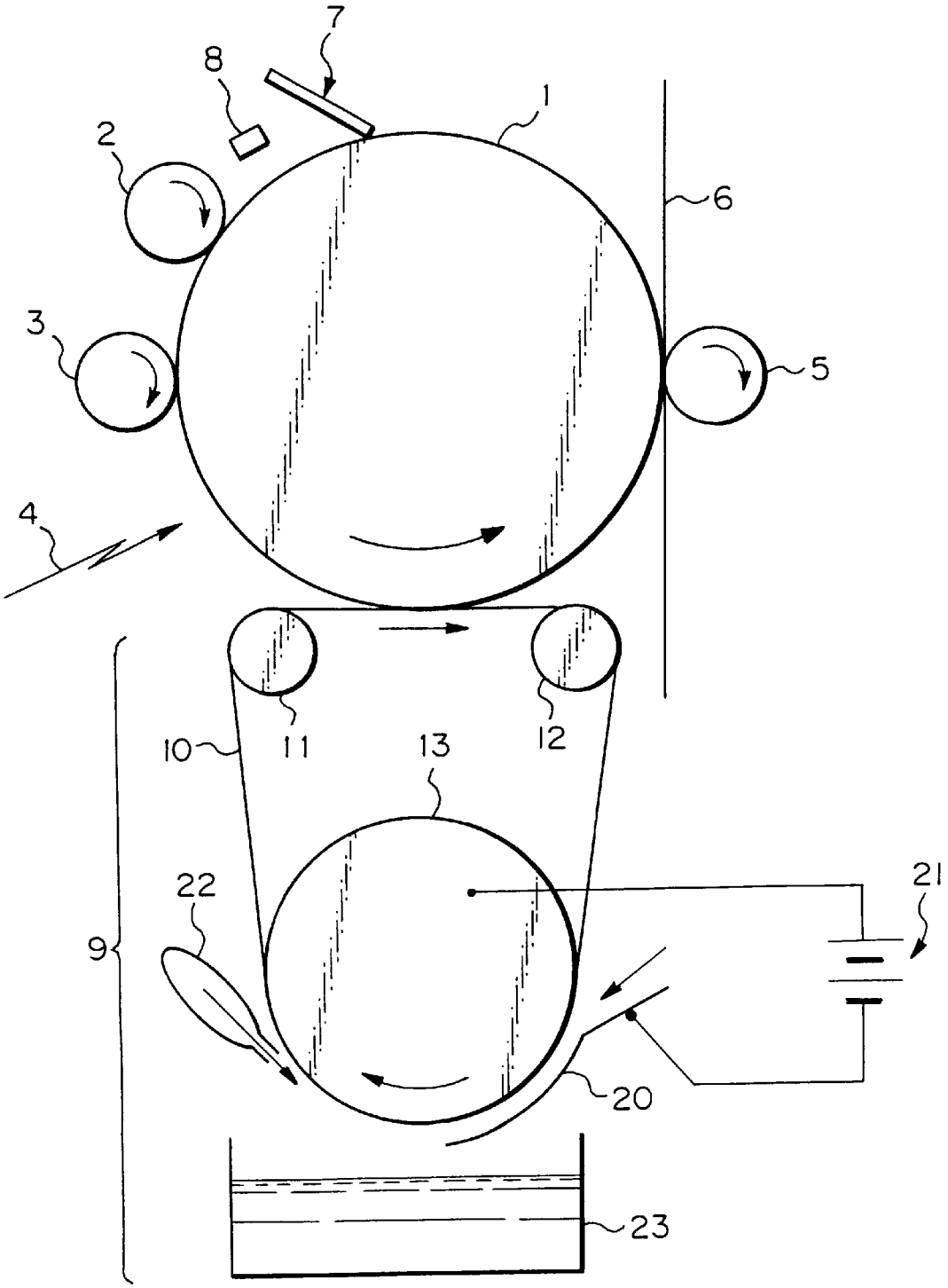
FIG. 1 is a view showing a first embodiment of an image forming apparatus in accordance with the present invention.

Referring to FIG. 1 of the drawings, an electrophotographic copier embodying the present invention is shown. As shown, the copier includes a photoconductive element in the form of a drum 1. Arranged around the drum 1 are a charge roller or charging device 2, an exposing device represented by a light beam 4, a wet developing device 9, a transfer roller or transfer device 5 for image transfer, a cleaning device including a cleaning blade 7, and a quenching lamp or similar discharger 8. An application roller or application device 3 for applying a prewetting liquid to the drum 1 is interposed between a charging position where the charge roller 2 is located and an exposing position where the exposing device is located.

The wet developing device 9 includes a belt or developer carrier 10, an electrode plate or developer regulating member 20 spaced from the belt 10 by a preselected gap, and a power source 21 for applying a bias for forming an electric field between the belt 10 and the electrode device 20. The belt 10 is passed over roller 11, 12 and 13 and moved at substantially the same speed as the drum 1, as measured at the position where the belt 10 faces the drum 1, in the direction indicated by an arrow in FIG. 1. An air nozzle or excess liquid removing means 22 is positioned downstream of the electrode plate 20 in the direction of movement of the belt 10, but upstream of the position where the belt 10 faces the drum 1. The air nozzle 22 removes an excess developing liquid existing in the surface portion of a developer layer formed on the belt 10. A tank 23 is positioned below the belt 10. The developing liquid fed, but not deposited on the belt 10 in the form of a thin layer, and dropping from the lowermost end of the electrode plate 20 and the excess developing liquid removed from the belt 10 by the air nozzle are collected in the tank 23.

In operation, while the drum 1 is rotated in the direction indicated by an arrow in FIG. 1, its surface is uniformly charged to the positive polarity by the charge roller 2. The application roller 3 forms a several microns thick uniform presetting layer on the charged surface of the drum 1. Subsequently, the exposing device scans the surface of the drum 1 with the light beam 4 in order to electrostatically form a latent image thereon. The developing device 9 develops the latent image and thereby produces a corresponding toner image. The prewetting layer formed on the drum 1 prevents the developer from depositing on the non-image area of the drum 1. The transfer roller 5 transfers the toner image from the drum 1 to a paper or similar recording medium 6 fed from a sheet feed section, not shown, to the surface of the drum 1. The paper 6 with the toner image is separated from the drum 1 by a separating device, not shown, and conveyed to a fixing device, not shown. After the toner image has been fixed on the paper 6 by the fixing device, the paper 6 is driven out of the copier. After the image transfer, the cleaning blade 7 removes toner left on the drum 1, and then the discharger 8 dissipates charge also left on the drum 1.

Figure 2:
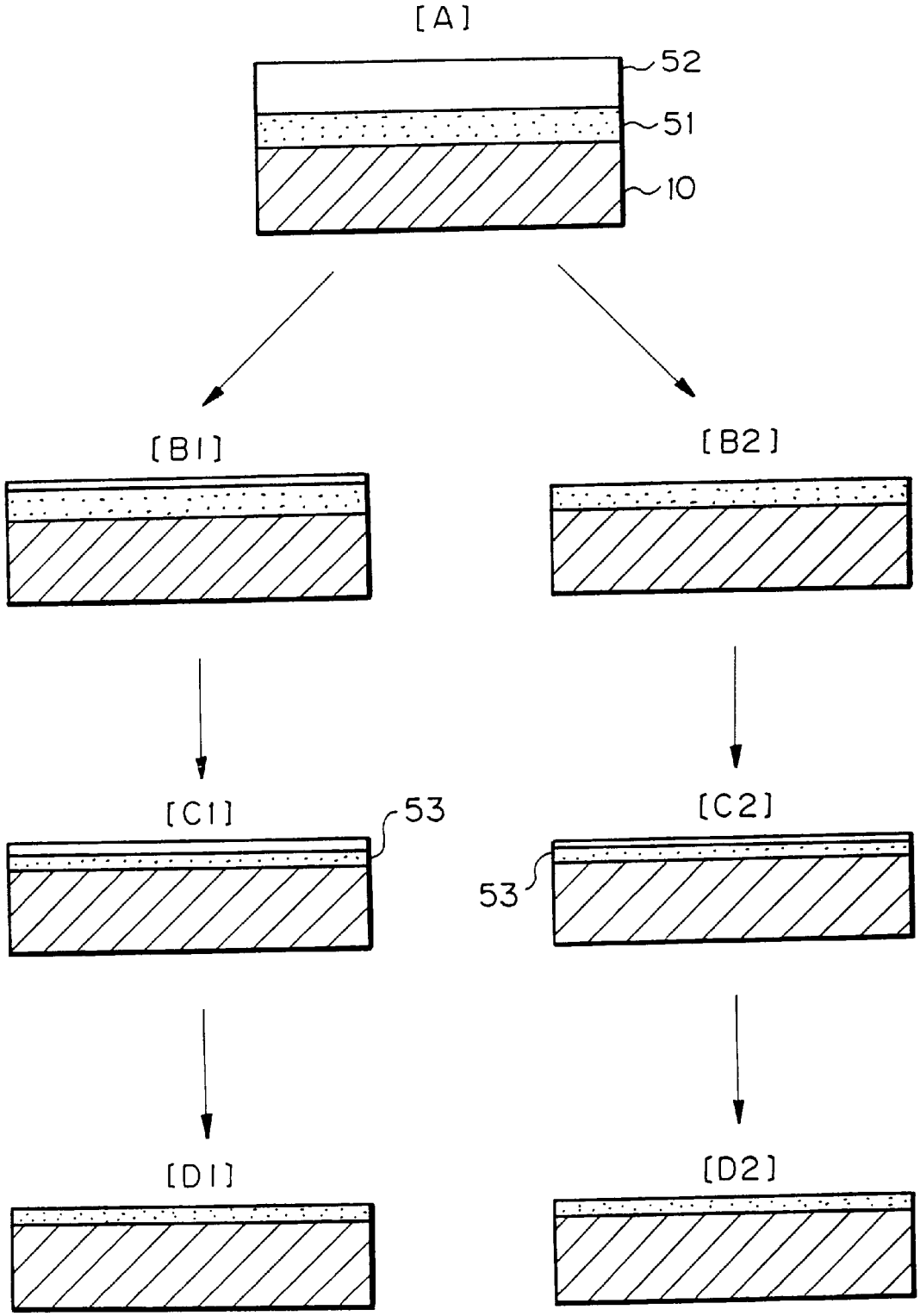
FIG. 2 shows a developer layer formed in a developer carrier in various conditions.

The operation of the developing device 9 will be described specifically. A developing liquid containing toner of negative polarity is fed to the gap between the belt 10 and the electrode plate 20, as indicated by an arrow in FIG. 1. The bias voltage applied from the power source 21 forms in the above gap an electric field causing the toner particles of negative polarity to move toward the surface of the belt 10 due to electrophoresis. The toner particles are therefore caused to deposit on the belt 10 due to electrophoresis. The electrophoresis continues until the electric field and the amount of toner particles deposited on the belt 10 reach electrical equilibrium, so that the toner particles are deposited on the belt 10 in a uniform amount As a result, as shown in FIG. 2, [A], a developer layer consisting of a high solid content portion 51 having a high toner content and an excess liquid portion or surface portion 52 having a low toner content are formed on the belt 10.

Figure 3:
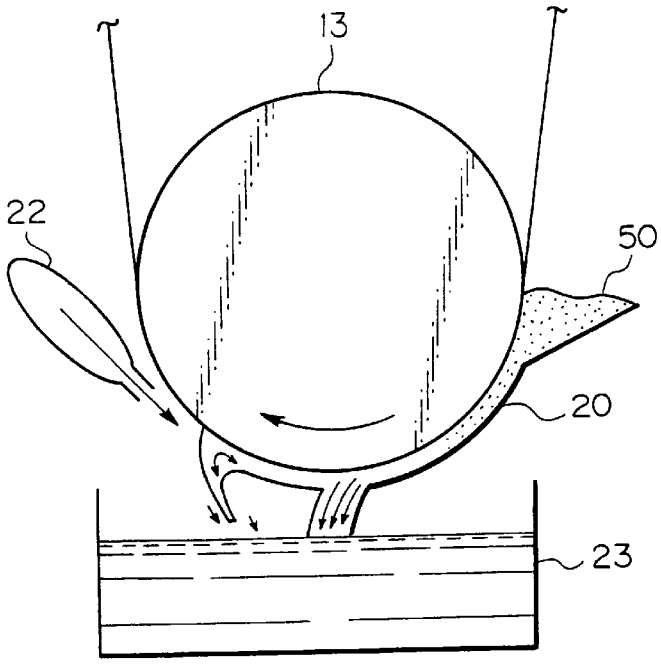
FIG. 3 shows a developing liquid of low toner density flowing down from the trailing end of developer regulating means, and an excess developing liquid removed from the developer layer formed on the developer carrier.

As shown in FIG. 3, a part of the developing liquid, labeled 50, fed to the gap between the belt 10 and the electrode plate 20 is not deposited on the belt 10. This part of the liquid 50 bas a low toner content and drops from the Lowermost end of the electrode plate 20 into the tank 23. This is promoted by gravity and the rotation of the belt 10. Consequently, the developing layer formed on the belt 10 is uniform and has a high toner content.

The bias voltage applied between the belt 10 and the electrode plate 20 acts in the direction for moving the toner particles away from the electrode plate 20, so that the toner particles are prevented from depositing on the plate 20.

The excess liquid portion 52 included in the developer layer is removed from the belt 10 by air jetted from the air nozzle 22. It is possible to remove only the excess liquid portion 52 from the belt 10 if air is jetted in an adequate condition. Consequently, as shown in FIG. 2, [B1] and [B2], the solid content of the developer layer, i.e., the toner content of the developer layer is further increased. As shown in FIG. 3, the excess liquid blown off by the air nozzle 22 is also collected in the tank 23.

At a developing position where the belt 10 faces the drum 1, a bias voltage for development is applied in order to separate the developer layer of high toner content from the belt 10, As a result, the developer is peeled off the belt 10 in the form of a layer and moved to the portion of the drum 1 where the latent image exists.

The prewetting liquid is applied to the drum 1 in order to protect the background of the drum 1 from contamination ascribable to the direct contact of the drum 1 and belt 10, as stated earlier. Because the developer layer of high toner content formed on the belt 10 has a uniform thickness, the thickness of the prewetting liquid is prevented from varying due to irregularity in the contact pressure acting between the liquid and the developer layer. Therefore, the prewetting liquid surely protects the background of the drum 1 from contamination.

The developing liquid to be fed to the gap between the belt 10 and the electrode plate 20 should preferably have a solid content of less than about 10% in weight inclusive. Excessively high solid contents would obstruct the migration of the toner particles in the developer, i.e., electrophoresis. Specifically, when the solid content of the developing liquid is greater than 10%, the electrophoresis characteristic of toner particles is too poor to easily form the high solid content portion 51 and excess liquid portion 52 shown in FIG. 2, [A]. Should the developer layer with the two portions 51 and 52 be not available, then the toner content of the developer layer would become irregular when the developer layer moves away from the trailing end of the electrode plate 20, because the surface portion would have a high viscosity. Consequently, it is difficult to form the uniform developing layer of high toner content on the belt 10.

Figure 4:
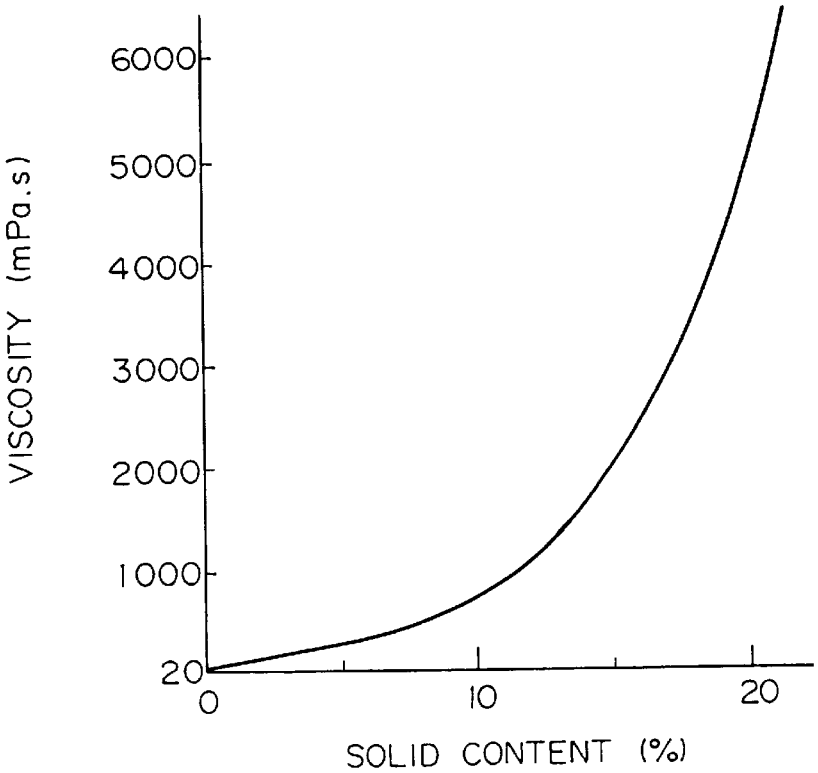
FIG. 4 is a graph showing a typical relation between the viscosity and the solid content of a developing liquid.

With the above developing system developing a latent image formed on the drum 1 with the developer layer of high toner content and high viscosity, it is preferable that the viscosity of the developer layer on the drum 1 be higher than several hundred mPa.s. FIG. 4 shows a typical relation between the solid content and the viscosity of a developer. As shown, to provide a developer layer with a viscosity higher than several hundred mPa.s, the solid content of the developer layer should be higher than 10%. In the illustrative embodiment, a developing liquid whose solid content is less than 10% inclusive is fed from a reservoir, not shown, to the gap between the belt 10 and the electrode plate 20. Such a liquid promotes the efficient electrophoresis of toner particles and thereby forms a uniform developer layer having a solid content of higher than 10% on the belt 10.

For example, when a 5% developing liquid is fed to the gap between the belt 10 and the electrode plate 20, its toner particles migrate toward the belt 10 due to electrophoresis caused by the electric field, forming the developer layer shown in FIG. 2, [A], on the belt 10. In this condition, the solid content of the developer layer is about 20% while the solid content of the excess liquid portion or surface portion 52 is about 0.1%. As FIG. 4 indicates, the high solid content portion 51 has a viscosity of about 6,000 mPa.s while the excess liquid portion 52 has a viscosity of about 20 mPa.s. Although such an excess liquid portion 52 is disturbed at the outlet of the electrode plate 20, it remains uniform due to the low viscosity. Moreover, because the viscosity of the high solid content portion 51 is far higher than the viscosity of the excess liquid portion 52, the former is prevented from being disturbed by the latter. The developer layer is therefore free from irregularity in toner content.

For comparison, assume that a 15% developing liquid is fed to the gap between the belt 10 and the electrode plate 20. Then, despite that the toner particles are subjected to the electric field, they are prevented from migrating easily, i.e., electrophoresis is obstructed. Although the resulting high solid content portion 51 has a solid content of about 20%, the surface portion of the developer layer has a solid content as high as about 10%. Furthermore, the high solid content portion 51 and surface portion 52 do not form a discrete double layer. While the portion 51 adjoining the surface of the belt 10 has a viscosity of about 6,000 mPa.s, the viscosity of the portion 52 is as high as about 800 mPa.s. Consequently, the portion 52 whose toner content is about 10% is disturbed at the outlet of the electrode plate 20 and brought out of uniformness. Moreover, the disturbed surface portion renders the portion 51 adjoining the belt 10 uneven, resulting in an irregular toner content distribution.

2nd Embodiment

Figure 5:
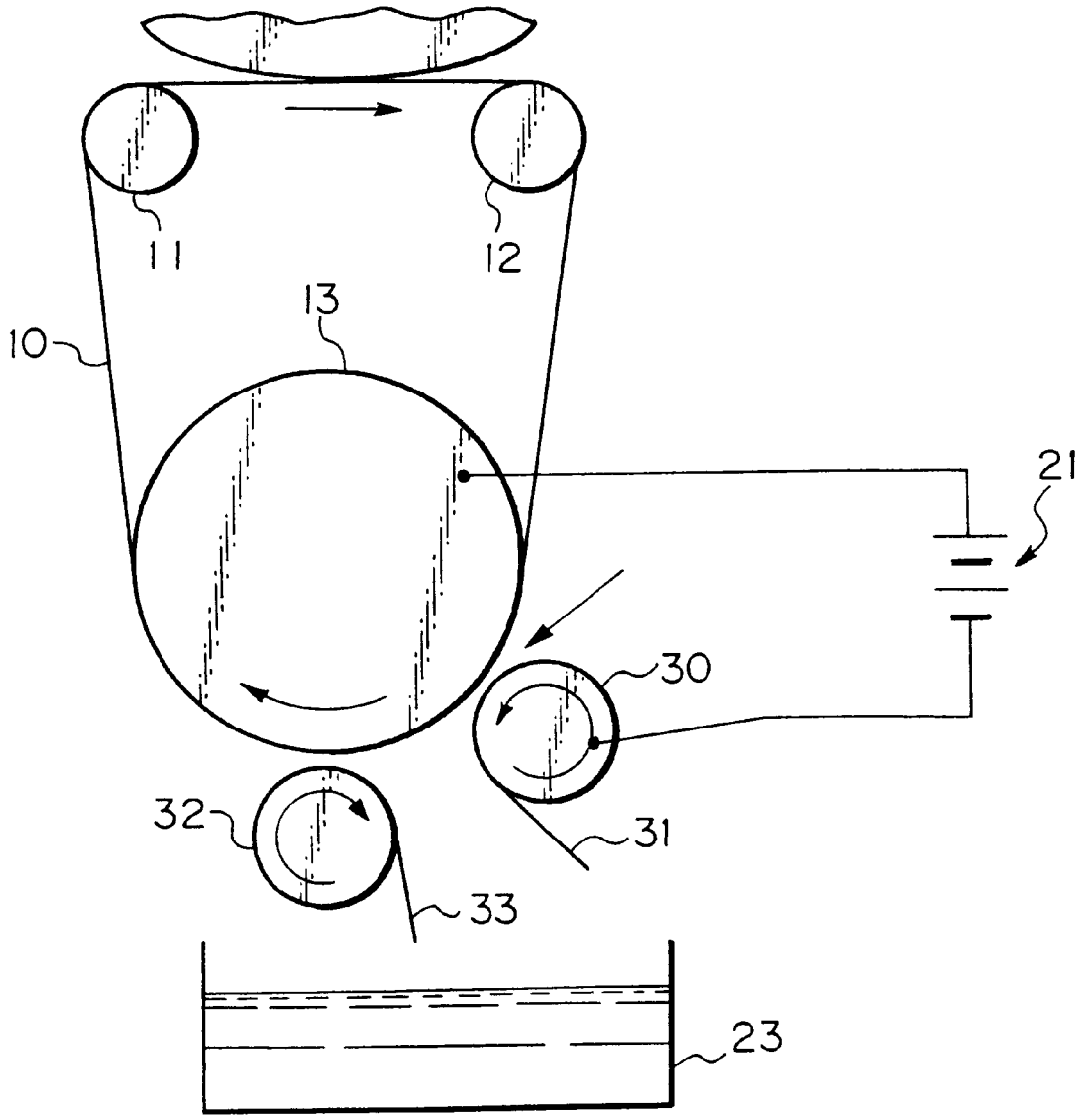
FIG. 5 shows a developing device representative of a second embodiment of the present invention.

Because this embodiment is identical with the first embodiment as to the basic construction and operation, its structural elements identical with the elements of the first embodiment will not be described in order to avoid redundancy. As shown in FIG. 5, a developing device representative of the second embodiment includes a rotatable electrode roller 30 spaced from the belt 10 by a preselected gap. The electrode roller 30 plays the role of the developer regulating means. A scraper 31 is used to clean the surface of the electrode roller 3. The gap between the belt 10 and the electrode roller 30 should preferably be several hundred microns to several microns, taking account of the fine oscillation of the belt 10. A reverse roller or excess liquid removing means 32 is spaced from the belt 10 by a preselected gap in order to remove the excess liquid from the surface portion of the developer layer formed on the belt 10. A scraper 33 is provided for removing the excess liquid from the surface of the reverse roller 32. As for the rest of the construction, this embodiment is identical with the first embodiment.

In operation, the developing liquid containing toner of negative polarity is fed to the gap between the belt 10 and the electrode roller 30, as indicated by an arrow in FIG. 5. The toner particles migrate toward the belt 10 due to electrophoresis caused by an electric field formed between the belt 10 and the electrode roller 30. As a result, the high solid content portion 51 with a high toner content and the excess liquid portion 52 with a low toner content are formed on the belt 10. The developing liquid with a low toner content and not deposited on the belt 10 drops from the bottom of the electrode roller 30 into the tank 23, As a result, a developer layer having a uniform high toner content is formed on the belt 10. The thickness of the high solid content portion 51 is influenced by the rotation speed of the electrode roller 30 and the bias voltage. Specifically, the thickness of the portion 51 increases with an increase in the rotation speed of the electrode roller 30 or an increase in the bias voltage, i.e., the strength of the electric field.

The scraper 31 removes impurities contaminating the surface of the electrode roller 30. The impurities include toner particles contained in the developer and charged to the opposite polarity, i.e., positive polarity in the illustrative embodiment. The scraper 31 therefore frees the electrode roller 30 from the deposition of toner particles and ensures stable formation of the developer layer.

The reverse roller 32 plays the role of squeeze roller type excess liquid removing means. The reverse roller 32 and scraper 33 cooperate to remove the excess liquid portion 52 overlying the high solid content portion 51. This further increases the solid content of the developer and implements a dense developer layer. The excess liquid portion 52 can be removed in a great amount if the reverse roller 32 is caused to move at a higher speed than the surface of the belt 10. The liquid 52 removed by the reverse roller 32 is also collected in the tank 23.

At the position where the belt 10 faces the drum 1, the dense developer layer on the belt 10 is peeled off in the form of a thin layer by the bias for development and moved toward the portion of the drum 1 where the latent image is formed. By varying the rotation speed of the electrode roller 30 or the bias voltage applied thereto, it is possible to control the thickness of the developer layer and therefore the image density.

3rd Embodiment

Figure 6:
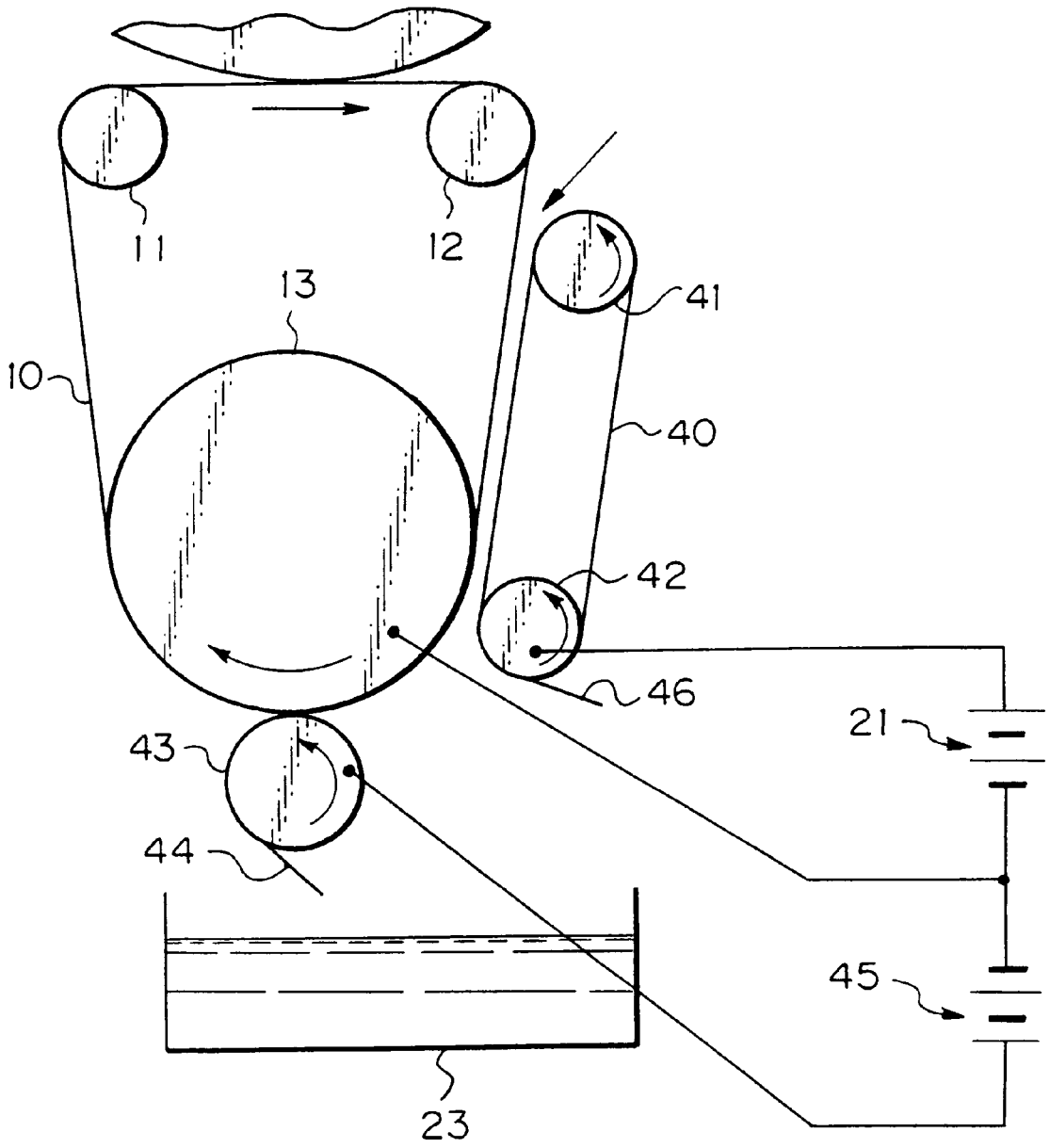
FIG. 6 shows a developing device representative of a third embodiment of the present invention.

Because this embodiment is also identical with the first embodiment as to the basic construction and operation, its structural elements identical with the elements of the first embodiment will not be described in order to avoid redundancy. As shown in FIG. 6, a developing device representative of the third embodiment includes a belt electrode 40 spaced from the belt 10 by a preselected gap. The belt electrode 40 plays the role of the developer regulating means. A scraper 46 is used to clean the surface of the belt electrode 40. The belt electrode 40 is passed over rollers 41 and 42 and caused to rotate in the direction indicated by an arrow in FIG. 6. A contact roller or excess liquid removing means 43 is held in contact with the belt 10 in order to remove the excess liquid portion of the developer layer formed on the belt 10. A scraper 44 is pressed against the contact roller 43 by a low pressure for removing the excess liquid from the roller 43. The surface of the contact roller 43 moves at the same speed as the surface of the belt 10. A power source 45 applies a preselected bias voltage to the contact roller 43. As for the rest of the construction, this embodiment is identical with the first embodiment.

In operation, a developing liquid containing toner particles of negative polarity is fed to the gap between the belt 10 and the belt electrode 40, as indicated by an arrow in FIG. 6. The toner particles migrate toward the belt 10 due to electrophoresis caused by an electric field formed between the belt 10 and the belt electrode 40. As a result, the high solid portion 51 with a high toner content and the excess liquid portion 52 with a low toner content are formed on the belt 10. The developing liquid with a low toner content and not deposited on the belt 10 drops from the bottom of the belt electrode roller 40 into the tank 23. As a result, a developer layer having a uniform, high toner content is formed on the belt 10.

The developer regulating means implemented by the belt electrode 40 is allowed to face the belt 10 over a broad area. This allows the developing liquid to efficiently form a uniform developer layer having a high toner content. Therefore, a developing liquid whose toner content is even lower than the toner content of the liquid of the first or second embodiment is usable. The thickness of the high solid content portion 51 is influenced by the moving speed of the surface of the belt electrode 40 and the bias voltage applied thereto. Specifically, the thickness of the high solid portion 51 increases with an increase in the moving speed of the belt electrode 40 or an increase in the bias voltage, i.e., the strength of the electric field.

The scraper 46 removes impurities contaminating the surface of the belt electrode roller 40. The impurities include toner particles contained in the developer and charged to the opposite polarity, i.e., positive polarity in the illustrative embodiment. The scraper 46 therefore frees the belt electrode 40 from the deposition of toner particles and ensures stable formation of the developer layer.

The excess liquid portion 52 of the developer layer formed on the belt 10 is transferred to the surface of the contact roller 43 and removed from the belt 10 thereby. Further, the excess liquid 52 is removed from the contact roller 43 by the scraper 44. A power source 45 applies a bias voltage of several hundred volts between the contact roller 43 and the belt 10, so that an electric field preventing the toner particles from depositing on the contact roller 43 is formed. Therefore, the toner particles on the belt 10 are held on the belt 10 and further increases the toner content of the developer layer.

The contact roller type excess liquid removing means differs from the squeeze roller type means in that it does not need any gap maintaining means and therefore simplifies the copier. However, because the contact roller type means is inferior in liquid removing efficiency to the squeeze roller type means, it is preferable to arrange a plurality of contact rollers side by side along the surface of the belt 10.

At the position where the belt 10 faces the drum 1, the dense developer layer on the belt 10 is peeled off in the form of a thin layer by the bias for development and moved toward the portion of the drum 1 where the latent image is formed.

4th Embodiment

Figure 7:
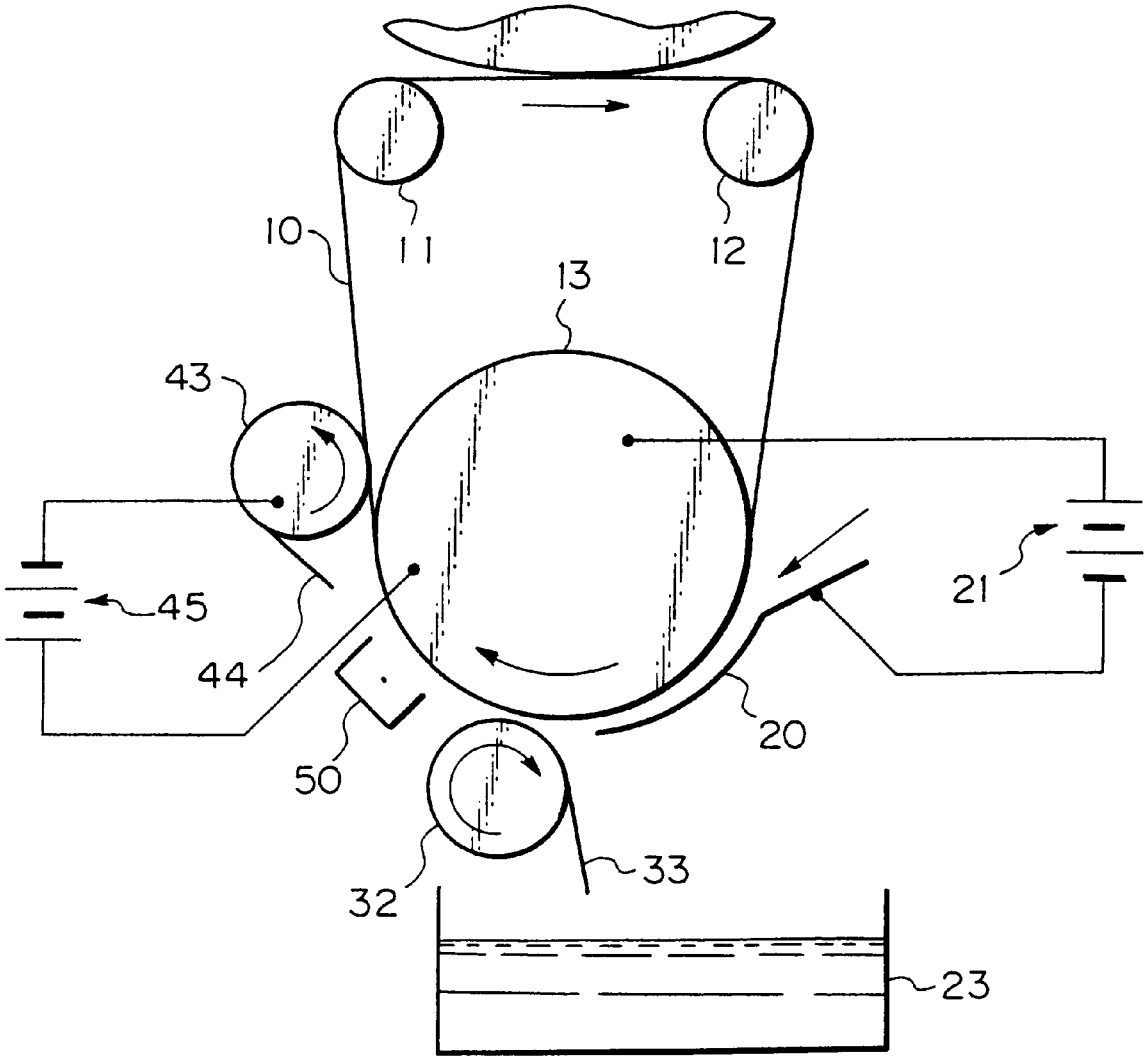
FIG. 7 shows a developing device representative of a fourth embodiment of the present invention.

Because this embodiment is also identical with the first embodiment as to the basic construction and operation, its structural elements identical with the elements of the first embodiment will not be described in order to avoid redundancy. As shown in FIG. 7, a developing device representative of the third embodiment also includes the electrode plate 20 of the first embodiment and the squeeze roller type excess liquid removing means 32 of the second embodiment. In this embodiment, a corona charger or discharge member 50 and the contact roller type excess liquid removing means 43 of the third embodiment cooperate to further increase the toner content of the developer on the belt 10 after the excess liquid portion has been removed. The corona charger 50 is located downstream of the reverse roller 32 in the direction of movement of the belt 10 in order to cause the toner particles of the developer to cohere. The contact roller 43 is located downstream of the corona charger in the above direction in order to remove the excess liquid portion from the developer layer, as stated earlier.

In operation, after the thin developer layer of high toner content has been formed on the belt 10, the excess liquid portion having a low toner content is removed from the developer layer. Then, to further increase the toner content of the developer layer, the toner particle of the developer are caused to cohere. For this purpose, a power source, not shown, applies a bias voltage to the corona charger 50 so as to generate negative ions. The negative ions generated by the corona charger 50 cause the toner particles of the developer deposited on the belt 10 to cohere. As a result, as shown in FIG. 2, [C1] or [C2], an extra-high solid content portion 53 is formed in the developer layer. An excess liquid with a low toner content newly appears on the surface of the extra high solid portion 53. The excess liquid is removed by the contact roller 43 located downstream of the corona charger 50 and applied with a preselected bias. Consequently, a developer layer with a further increased toner content is formed on the belt 10, as shows in FIG. 2, [D1] or [D2].

If desired, the corona charger 50 for causing the toner particles to cohere may be replaced with a discharge roller so positioned as not to contact the developer layer formed on the belt 10. In such an alternative case, a scraper can be associated with the discharge roller in order to clean the surface of the roller, ensuring the stable cohesion of the toner particles.

At the position where the belt 10 faces the drum 1, the dense developer Layer on the belt 10 is peeled off in the form of a thin layer by the bias for development and moved toward the portion of the drum 1 where the latent image is formed

5th Embodiment

Figure 8:
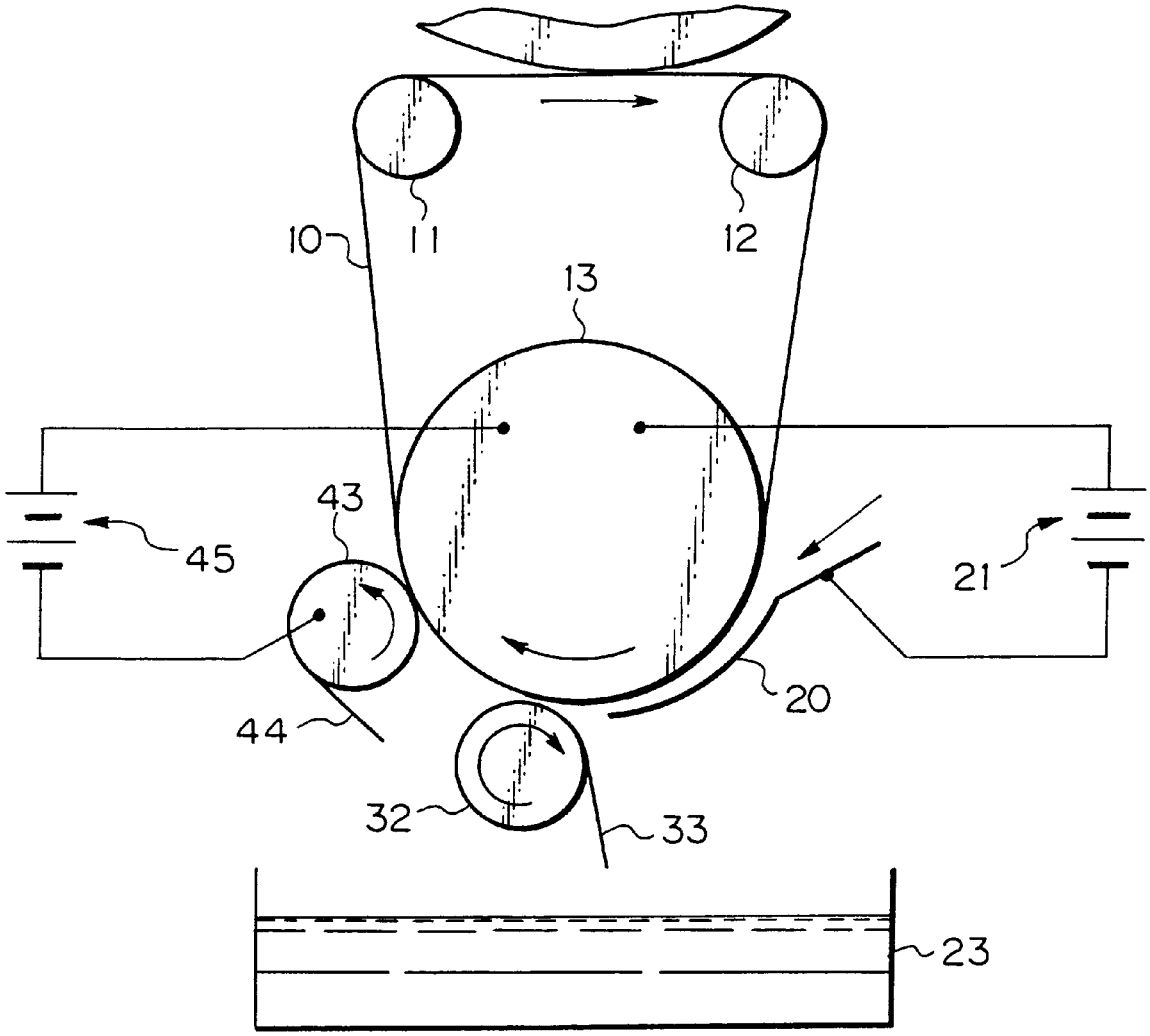
FIG. 8 shows a developing device representative of a fifth embodiment of the present invention.

Because this embodiment is also identical with the first embodiment as to the basic construction and operation, its structural elements identical with the elements of the first embodiment will not be described in order to avoid redundancy. FIG. 8 shows a developing device representative of the fifth embodiment of the present invention. As shown, the developing device also includes the electrode plate 20 for forming the dense developing layer on the belt 10, and the squeeze roller type excess liquid removing means 32 for removing the excess liquid. In this embodiment, as in the third embodiment, the contact roller type excess liquid removing means 43 is used to further increase the toner content of the developer on the belt 10 after the excess liquid portion has been removed. The contact roller or excess liquid removing means 43 is located downstream of the reverse roller 32 in the direction of movement of the belt 10 in order to cause the toner particles of the developer to cohere. The scraper 44 is held in contact with the contact roller 43. The power source 45 applies a bias voltage to the contact roller 43.

In operation, after the thin developer layer of high toner content has been formed on the belt 10, the excess liquid portion having a low toner content is removed from the developer layer. Then, to further increase the toner content of the developer layer, the toner particles of the developer are caused to cohere. For this purpose, the power source 45 applies a voltage to the contact roller 43 so as to generate negative ions. This can be done if the voltage applied to the contact roller 43 is selected to be slightly higher than the voltage applied to the contact roller or excess liquid removing means included in the third embodiment, e.g., 1 kV or above. The negative ions cause the toner of the developer on the belt 10 to core, and at the same time remove the excess liquid as in the third embodiment. As a result, a developer layer having a high toner content is formed on the belt 10, as shown in FIG. 2, [D1] or [D2].

The excess liquid removing means implemented by the squeeze roller scheme is capable of removing a great amount of excess liquid. However, the squeeze roller scheme is apt to render the removal of the excess liquid non-uniform due to, e.g., variation in the gap between the non-contact squeeze roller and the belt 10. In addition, means for guaranteeing the gap between the squeeze roller and the belt 10 is essential, resulting in a complicated configuration. By contrast, the contact roller scheme described above serves not only as a discharge member or means for causing the toner particles of the developer to cohere, but also as the excess liquid removing means for removing the excess liquid evenly.

At the position where the belt 10 faces the drum 1, the dense developer layer on the belt 10 is peeled off in the form of a thin layer by the bias for development and moved toward the portion of the drum 1 where the latent image is formed.

The developer regulating means for forming a thin developer layer on the belt 10, excessive liquid removing means, and means for causing the toner particles of the developer to cohere shown and described in relation to the first to fifth embodiments are only illustrative. Further, while the embodiments have concentrated on a photoconductive element chargeable to the positive polarity and toner chargeable to the negative polarity, the present invention is similarly practicable with a photoconductive element and toner each being chargeable to the opposite polarity.

An embodiment to be described hereinafter is implemented as a copier of the type forming a thin layer of developing liquid having a high toner content on a developer carrier, and causing the developer layer to contact the surface of an image carrier for developing a latent image formed on the image carrier. The following embodiment is constructed such that after the formation of the thin developer layer on the developer carrier, but before the contact of the developer layer with the image carrier, toner particles contained in the developing liquid cohere.

6th Embodiment

Figure 9:
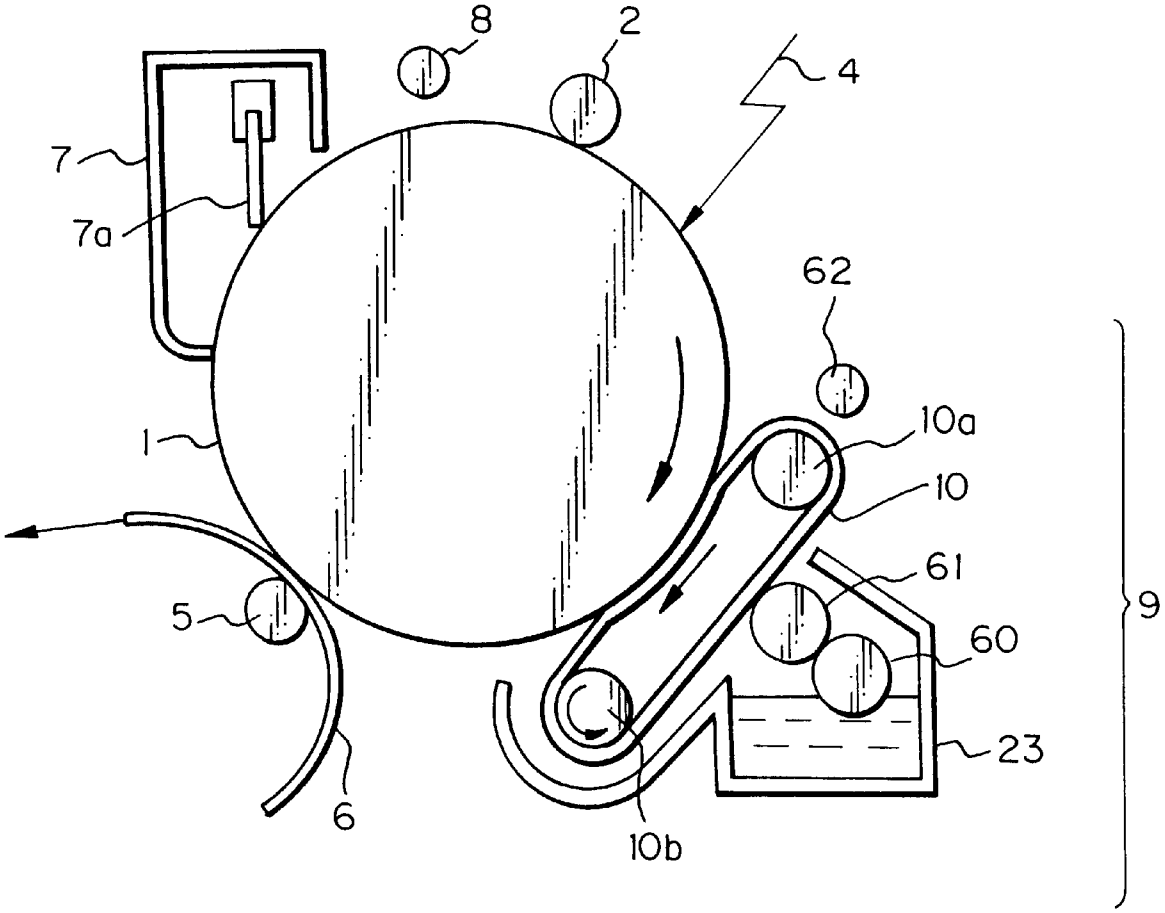
FIG. 9 shows a sixth embodiment of the present invention.

Referring to FIG. 9, a sixth embodiment of the present invention also includes the drum or image carrier 1 and the charge roller or charger 2, exposing device represented by the light beam 4, developing device 9, transfer roller or transfer device 5, cleaning device 7 including a cleaning blade 7*a*, and discharger 8.

The developing device 9 has a draw-up roller 60 and an application roller 61 as well as the belt 10 and tank 23. In the illustrative embodiment, the tank 23 is used to store a fresh developing liquid. The application roller 61 has its lower portion immersed in the developing liquid stored in the tank 23. The application roller 60 applies the developing liquid or developer drawn up by the draw-up roller 60 to the belt 10 in the form of a thin layer. The belt 10 is passed over a first and a second roller 10*a* and 10*b* and moved substantially at the same speed as the drum 1, as measured as the position where the belt 10 contacts the drum 1, in the direction indicated by an arrow in FIG. 9. A charge member 62 faces the first roller 10*a* with the intermediary of the belt 10 and causes the thin developer layer formed on the belt 10 to cohere, as will be described specifically later.

Figure 10A:
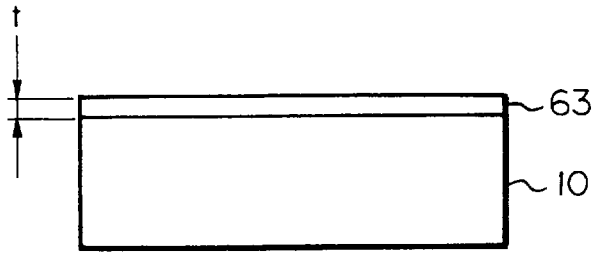
FIGS. 10A and 10B demonstrate a developing step.
Figure 10B:
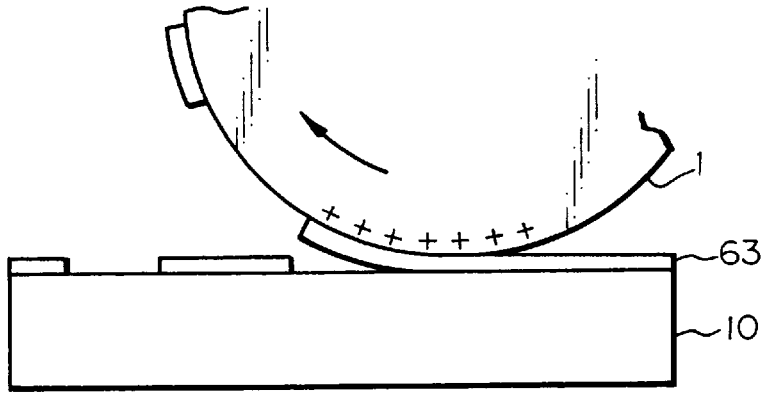

In operation, while the drum 1 is rotated in the direction indicated by an arrow in FIG. 9, the charge roller 2 uniformly charges the surface of the drum 1. The exposing device 4 focuses an imagewise reflection representative of a document onto the charged surface of the drum 1 with optics, not shown. As a result, a latent image is electrostatically formed on the drum 1. The developing device 9 develops the latent image and thereby produces a corresponding toner image. Specifically, as shown in FIG. 10A, the developer drawn up by the roller 60 is applied to the belt 10 by the application roller 61 in the form of a thin layer 63. Then, as shown in FIG. 10B, at a developing position where the belt 10 and drum 1 contact each other, the developer layer 63 is peeled off the belt 10 in the form of a layer and transferred to the portion of the drum 1 where the latent image exists. The transfer roller 5 transfers the resulting toner image from the drum 1 to a paper or similar recording medium 6 fed from a sheet feed section, not shown, in the direction indicated by an arrow in FIG. 9. The paper 6 with the toner image is separated from the drum 1 and conveyed to a fixing unit, not shown. After the toner image has been fixed on the paper 6 by the fixing unit, the paper 6 is driven out of the copier. After the image transfer, the cleaning device 7 removes the toner left on the drum 1, and then the discharger 8 dissipates charge also left on the drum 1.

The application roller 61 regulates the developer layer formed on the belt 10 to a thickness implementing a target image density. The thickness is therefore dependent on factors determining the image density, i.e., the mixture ratio of a coloring agent in the developer and the kind of papers used. Specifically, the thickness of the developer layer decreases with an increase in the mixture ratio of a coloring agent or in the degree of smoothness of the surface of a paper. In the illustrative embodiment, the thickness of the developer layer is selected to be 5 $\mu$m or above, but 40 $\mu$m or below, preferably 5 $\mu$m or above, but 20 $\mu$m or below. With this range of thickness, it is possible to obviate background contamination due to excessive toner deposition ascribable to an excessively thick developer layer, and the irregularity of a solid image ascribable to an excessively thin developer layer.

In FIG. 10B, assume that the contact pressure acting between the developer layer formed on the belt 10 and the drum 1 is high. Then, the developer layer between the belt 10 and the drum 1 escapes to portions where no pressures act or only weak pressures acts. Therefore, any irregularity in contact pressure directly translates into irregularity in the thickness of the developer layer, causing the developer to deposit on the drum 1 in an irregular amount. In the illustrative embodiment, to stabilize the thickness of the developer layer against irregularity in contact pressure, the means 62 for causing the toner particles of the developer layer 63 and containing a coloring agent to cohere is located downstream of the position where the developer layer is formed on the belt 20 in the direction of rotation of the belt 10, but upstream of the position where the belt 10 contacts the drum 1. It is to be noted that toner particles containing a coloring agent and applicable to a developing liquid should have a diameter of greater than 0.05 $\mu$m inclusive, but smaller than 5 $\mu$m inclusive. In the case where the cohesion of toner particles is increased, the diameter of the toner particles should preferably be 0.1 $\mu$m or above because excessively fine toner particles would reduce their distance and would be difficult to migrate toward the drum 1.

As shown in FIG. 9, the charge member 62 for causing the toner particles to cohere weakly charges the developer layer from above without contacting it. The charge member 62 is configured such that a current flows through the developer layer formed on the belt 10 and regulated by the application roller without causing the thickness of the developer layer to vary. Specifically, the charge member 62 is implemented as a charge wire with a grid, a metal roller having a medium resistance surface layer, or a metal plate spaced from the surface of the belt 10 by 50 $\mu$m or 100 $\mu$m. The charge member 62 effects glow discharge or discharge of a degree generating pulseless corona. This kind of discharge causes positive and negative charges to gather between the toner particles facing each other, so that an intense electric field is formed in the gaps. Such a phenomenon is known as a Johnsen-Rahbec effect.

Figure 11:
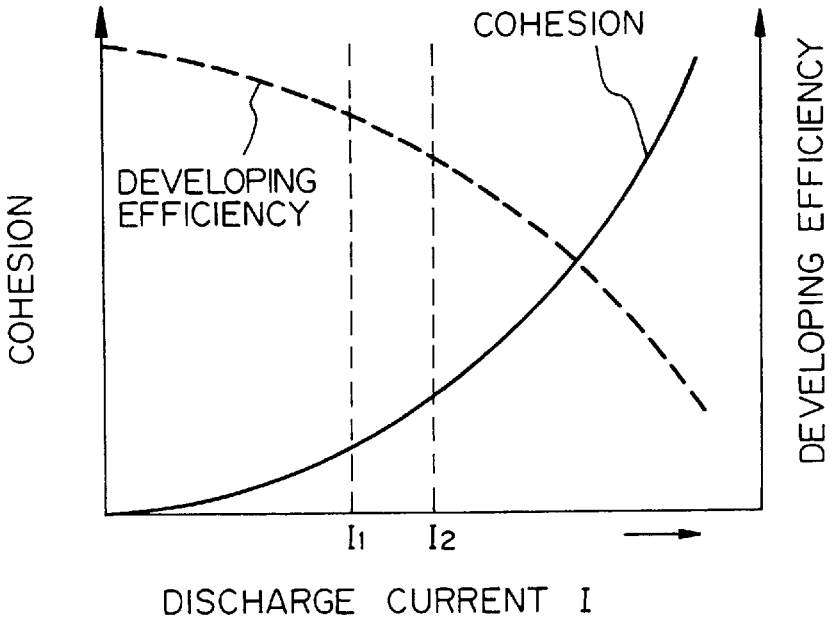
FIG. 11 is a graph showing a relation between a discharge current and a cohesion acting between toner particles and developing efficiency.

FIG. 11 shows a relation between the discharge current and the cohesion of toner particles and developing efficiency. If the Johnsen-Rahbec effect is excessively enhanced in order to increase the cohesion of toner particles, then adhesion acting between the belt 10 and the developer layer 63 also increases, reducing the amount of developer to be transferred to the drum 1. That is, the developing efficiency decreases, as shown in FIG. 11. On the other hand, if the Johnsen-Rahbec effect is excessively reduced, the cohesion of toner particles also decreases. The illustrative embodiment, using glow discharge or discharge of the above-mentioned degree, sets up such a relation that the amount of variation of a discharge current decreases relative to the amount of vacation of the voltage applied to the charge member 62. This allows the charge to be delicately adjusted in order to balance the stabilization of the thickness of the developer layer 63 and the developing efficiency.

It is to be noted that the charge member 62 for the cohesion of toner particles is operable with either one of the positive polarity and negative polarity. However, it is desirable to apply a voltage of the same polarity as the toner to the charge member 62 in order to obviate background contamination.

As stated above, in this embodiment, the toner particles of the thin developer layer 63 formed on the belt are caused to cohere before the layer 63 contacts the drum 1, thereby reinforcing the layer 63. This stabilizes the thickness of the developer layer 63 even when the contact pressure acting between the developer layer 63 and the drum 1 is irregular. It follows that a stable image is achievable even with a low viscosity developer because the developer is fed to the drum 1 in a uniform amount. In addition, even when the contact pressure is high, there occurs a minimum of irregularity in the amount of developer to be fed to the drum 1. This guarantees a margin as to the setting of the contact pressure.

Further, the illustrative embodiment, using glow discharge or discharge of the previously mentioned degree, sets up such a relation that the amount of variation of a discharge current decreases relative to the amount of variation of the voltage applied to the charge member 62. This allows the charge to be delicately adjusted in order to balance the stabilization of the thickness of the developer layer 63 and the developing efficiency.

In addition, the thickness of the developer layer for implementing a desired image density is confined in the range of from 5 $\mu$m to 40 $\mu$m. This frees an image from contamination due to excessive toner deposition ascribable to an excessive thickness and frees a solid image from irregularity ascribable to a short thickness.

The belt 10 may be formed of metal or elastic material or may have its one side expected to form the developer layer formed of a resin and the other side treated for electric conduction. If desired, the belt 10 may be replaced with a roller. In such a case, to ensure the thickness of the developer layer on the roller, spacer roller greater in diameter than the roller will be positioned at both ends of the roller and held in contact with the drum 1.

If background contamination is apt to occur due to the contact of the thin developer layer having a high toner contact with the drum 1, this embodiment may also apply a prewetting liquid to the drum 1. The application of the prewetting liquid will be effected before development, e,g., before charging, between charging and exposure or between exposure and development.

Embodiments to be described hereinafter each is implemented as a copier having a wet developing device including a reservoir storing a developing liquid consisting at least of a carrier liquid and toner. A developing member is formed with a number of lugs on its circumferential surface which contact the surface of in image carrier. The developing member is rotatable while holding the developer between its lugs, thereby feeding the developer to the image carrier. A regulating member is held in contact with the surface of the developing member in order to regulate the amount of developer held between the lugs. Liquid replenishing means replenishes one of the developing liquid, the carrier liquid and a liquid similar to the carrier liquid to a developing position where the image carrier and developing member face each other over a preselected distance.

7th Embodiment

Figure 12:
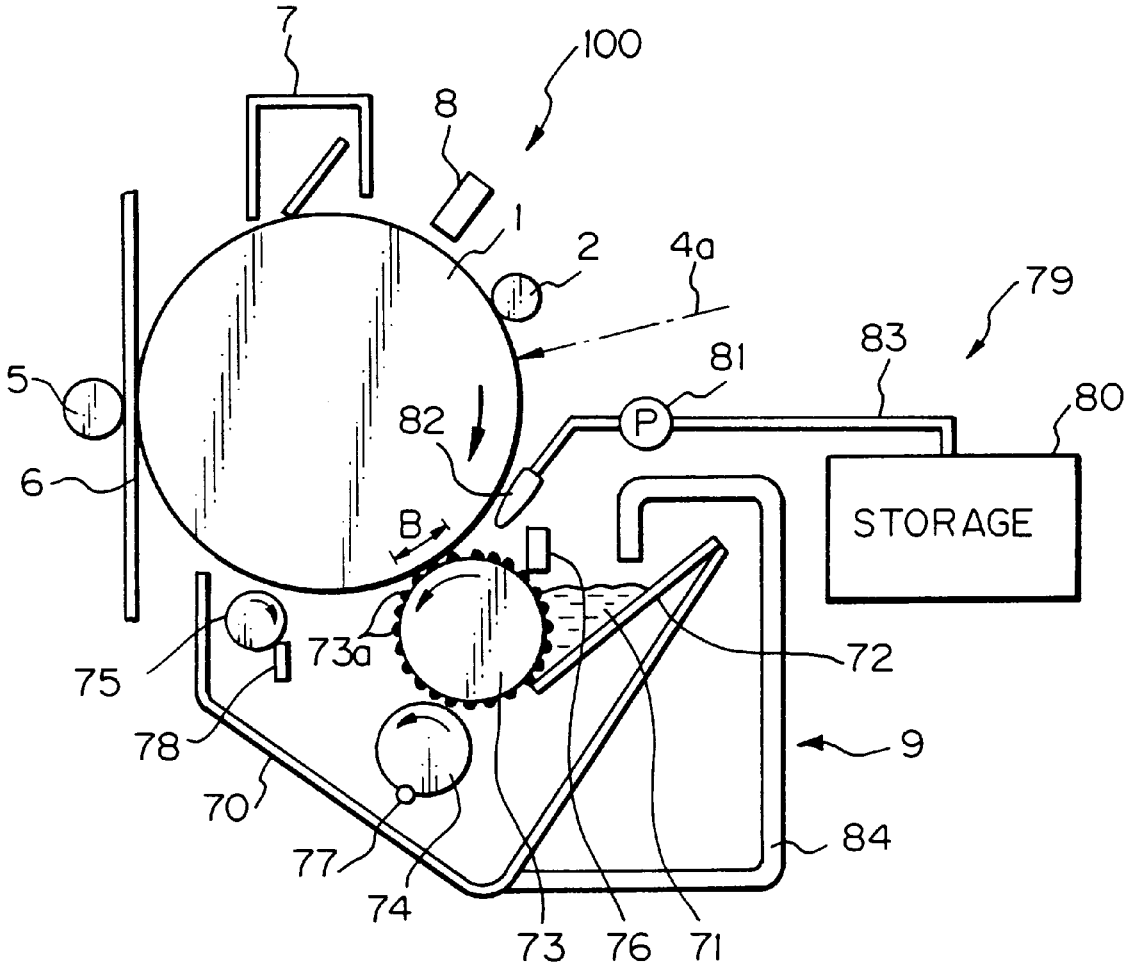
FIG. 12 shows a seventh embodiment of the present invention.

Referring to FIG. 12, a copier 100 representative of a seventh embodiment is shown, As shown, after the surface of the drum 1 has been charged by the charger (charge roller) 2, the laser beam 4*a* issuing from the exposing device, not shown, scans the charged surface of the drum 1 so as to form a latent image. The developing device 9 develops the latent image and thereby produces a corresponding toner image. The toner image is transferred by the transfer unit (transfer roller) 5 to the paper 6 fed from the sheet feed section, not shown. The toner image is fixed on the paper 6 by the fixing unit, not shown. The cleaning unit 7 removes the toner left on the drum 1 after the image transfer, and then the discharger 8 dissipates charge also left on the drum 1.

The developing device 9 includes a casing 70 whose upper portion is implemented as a reservoir 72 storing a developing liquid 71. A developing member in the form of a roller 73, a cleaning roller 74 held in contact with the roller 73 and formed of a foam material, a discharge body in the form of an electric field roller 75 and so forth are mounted on the casing 70. A blade or developer regulating member 76 regulates the amount of liquid 71 to be held on the circumferential surface of the developing roller 73. A squeeze bar 77 squeezes off the developing liquid 77 from the cleaning roller 74 and thereby refreshes the roller 74. A blade 78 scrapes off the liquid 71 from the electric field roller 75. The electric field roller 75 faces the drum 1, but the former does not contact the latter with the intermediary of the carrier liquid.

The developing liquid 71 is a mixture of carrier liquid, toner, and additive. The additive is used to maintain the polarity of toner and to promote the fixation of toner. Properties including the solid content or toner content and viscosity depend on the developing liquid 71. A number of lugs 73*a* are formed on the circumferential surface of the developing roller 73. The lugs 73*a* protrude to a height of 10 $\mu$m to 500 $\mu$m although it depends on the properties of the developing liquid 71. A single lug 73*a* is located in a unit area of 1 $mm^2$ to 5 $mm^2$. The developing roller 73 has a core formed of metal and to which a bias for development is applied. At least the tips of the lugs 73*a* contacting the drum 1 are insulated.

Figure 13A:
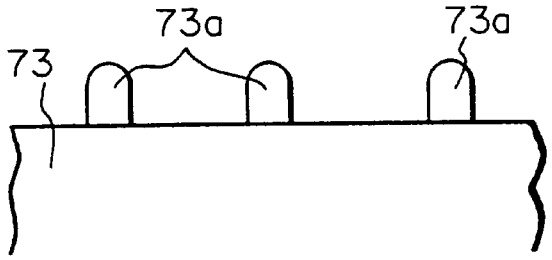
FIGS. 13A and 13B are views as seen in the direction perpendicular to the axis of a developing member.
Figure 13B:
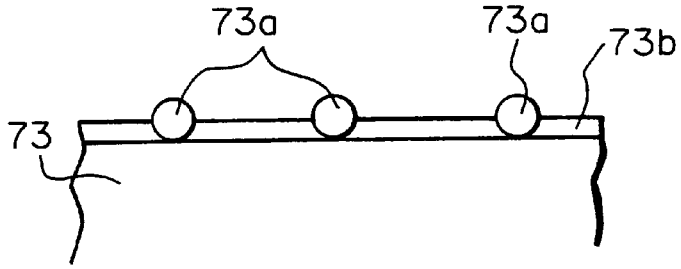
Figure 14:
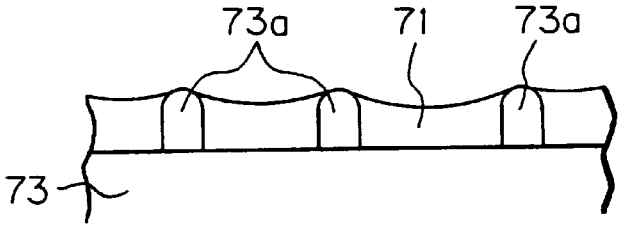
FIG. 14 shows bow the developing member retains a developing liquid.

FIGS. 13A and 13B each shows a specific method of forming the lugs 73*a*. In FIG. 13A, particles formed of a resin or similar insulator are fixedly arranged on the circumferential surface of the developing roller 73 formed of metal. In FIG. 13B, particles formed of a resin or similar insulator are fixedly arranged on the circumferential surface of the core of the developing member 73 formed of metal, and buried in a resin layer 73*b*. Of course, the lugs 73*a* may be formed by chemical etching. FIGS. 13A, 13B and 14 each shows a part of the circumference of the developing roller 73 in the direction perpendicular to the axis of the roller 73.

As shown in FIG. 12, a liquid replenishing device or replenishing means 79 replenishes the previously mentioned liquid to the developing position where the drum 1 and developing roller 13 face each other over a preselected width, i.e., a nip B. The liquid replenishing device 79 has a storage storing the liquid to be replenished, a pump 81, a nozzle 82 directed toward the surface portion of the developing roller 73 adjoining the drum , and a piping connecting them. The liquid refers to the developing liquid 71 containing toner, the carrier liquid, or a liquid similar to the carrier liquid, as stated earlier. Assuming that the carrier liquid is Isoper (mineral oil) by way of example, then the liquid similar to the carrier liquid is Isoper G, Isoper H or the like. The bottom of the casing 70 and reservoir 72 arc connected by a collection pipe 84.

In operation, the developing roller 73 is rotated counterclockwise, as viewed in FIG. 12, conveying the developing liquid 71 retained between its lugs 73*a*. Before the liquid 71 is fed to the drum 1, it is regulated to a constant amount by the regulating member 76. As shown in FIG. 14, the liquid 71 present an the lugs 73*a* slightly rises due to the wettability of the lugs 73*a* while the liquid 71 between the lugs 73*a* forms concave meniscuses. Should the lugs 73*a* contact the surface of the drum 1 in the condition shown in FIG. 14, only the liquid 71 present on the lugs 73 would contact the drum 1.

In light of the above, the liquid replenishing device 79 replenishes a preselected amount of liquid to the developing position, using the regulated amount of liquid 71 as a reference. The liquid should only be replenished in an amount sufficient for the developing liquid 71 to fill up the nip B. As a result, the developing liquid 71 fitting the gaps between the lugs 73*a* and controlled by the height of the lugs 73*a* contact the drum 1 over the nip B in the form of a thin layer, allowing the toner to migrate toward the latent image of the drum 1 due to electrophoresis. This prevents dots from being lost in the case of a solid image implemented by continuous dots or a thin line image.

Although the lugs 73*a* of the developing roller 73 contact the drum 1, the latent image is prevented from leaking via the lugs 73*a* because at least the tips of the lugs 73*a* are insulated. The drum 1 and developing roller 73 should preferably be moved at the same linear velocity; otherwise, the lugs 73*a* might rub themselves against the toner deposited on the drum 1.

The amount of toner contained in the developing liquid 71 may be represented by a solid content, i.e., the ratio in weight of the toner to the entire liquid. Generally, the viscosity of the liquid 71 increases with an increase in solid content. So long as the viscosity is high, a desired image density is attainable even when the height of the lugs 73*a* is reduced in order to thin the layer of the liquid 71 as far as possible.

Although the viscosity of the liquid to be replenished by the liquid replenishing device 79 depends on the liquid, the device 79 can forcibly replenish the liquid even if its viscosity is high. This allows the liquid to be selected from a broad range of liquids. When the liquid is the liquid 71 containing toner, the developing liquid 71 itself may be replenished from the reservoir 72. This makes the storage 80 needless.

Just before the surface of the drum 1 moved away from the developing roller 73 approaches the electric field roller or discharge body 75, a voltage is applied to the roller 75 and causes it to discharge. For example, when the gap between the drum 1 and the roller 75 is about 100 $\mu$m, the roller 75 discharges when applied with a voltage of about 10 V/$\mu$m. The discharge causes only the carrier liquid of the developing liquid 71 deposited on the drum 1 flies toward the roller 75. Consequently, the excess liquid on the drum 1 is collected immediately while the toner on the drum 1 is caused to cohere due to the discharge. It follows that the toner can be faithfully transferred from the drum 1 to the paper 6 by the transfer unit 7 without being crushed.

The timing for driving the pump 81 is controllable in order to replenish the liquid for a preselected period of time from the time just before the start of an image formation. This allows the liquid replenishment to be effected for a minimum necessary period of time during development and thereby obviates the excessive supply of the liquid. Although text data with spaced rows or a photograph or similar graphic data each is represented by a particular latent image pattern on the drum 1, the latent image patter can be identified beforehand or the basis of input image data. It is therefore possible to replenish the liquid from the device 79 either continuously or intermittently, as the case may be. In such a case, the liquid is replenished to the developing position at a timing corresponding to the pitch of the latent image, and is therefore prevented from being replenished in an excessive amount In any case, there can be obviated an occurrence that the excess developing liquid 71 reaches unexpected portions and smear them.

8th Embodiment

Figure 15:
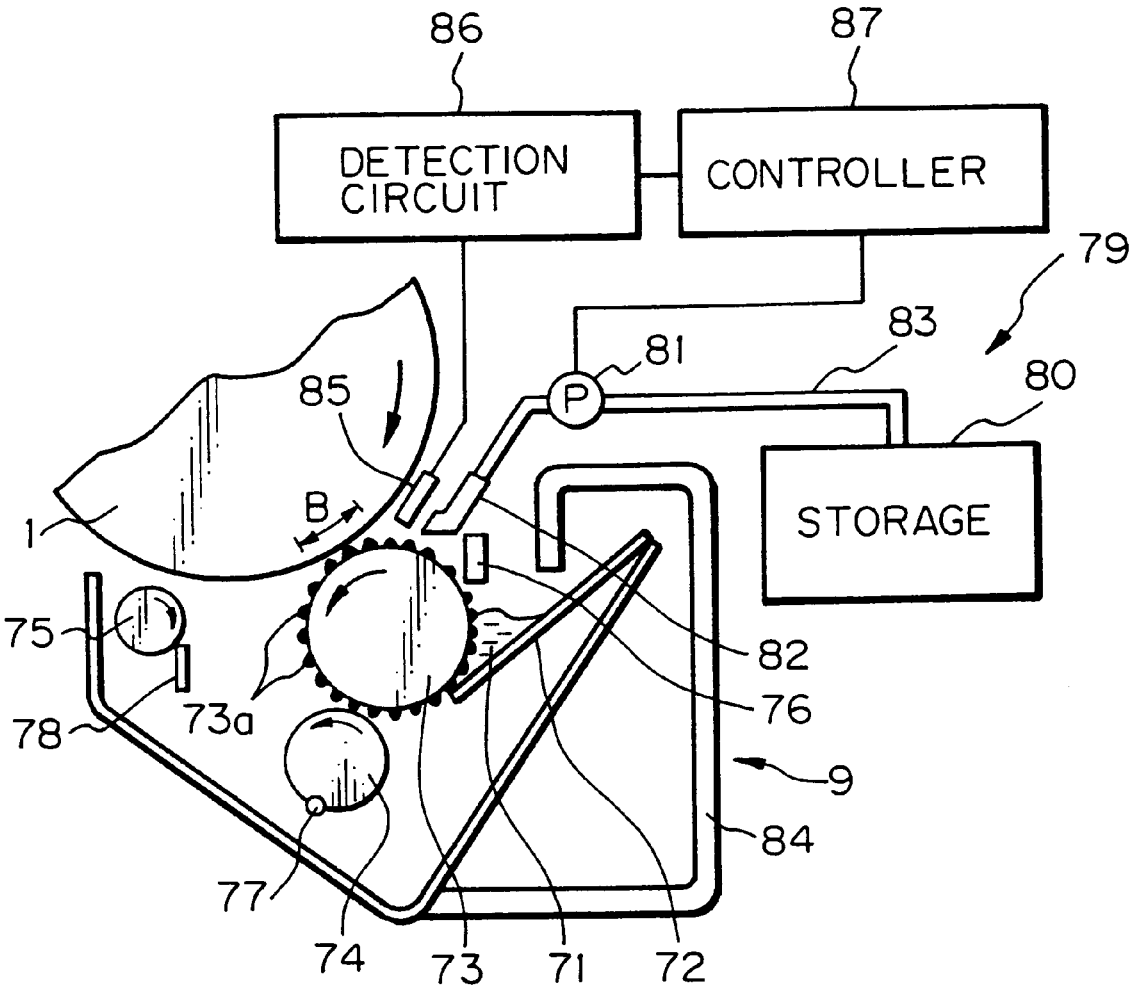
FIGS. 15, 16 and 17 respectively show eighth, ninth and tenth embodiments of the present invention.

In this embodiment and other embodiments to follow, the same structural elements as the elements shown in FIGS. 12 and 14 are designated by like reference numerals, and a detailed description thereof will not be made in order to avoid redundancy. As shown in FIG. 15, a sensor 85 responsive to the level of the liquid replenished to the developing roller 73 is located in the vicinity of the nozzle 82. A detection circuit 86 processes the output signal of the sensor 85. A controller 87 controls the operation of the pump 81 in response to the output of the detection circuit 86.

In the above configuration, while the sensor 85 senses the level of the liquid replenished to the developing roller 73, the detection circuit 86 determines, based on the output of the sensor 85, whether or not the amount of replenishment, i.e., the nip width B at the developing position and implemented by the developing liquid 71 is adequate. The controller 87 drives the pump 81 in response to the result of the above decision so that the replenishment of the liquid can be accurately controlled. This enhances the reliability of development and obviates the excessive replenishment of the liquid which would lead to contamination.

9th Embodiment

Figure 16:
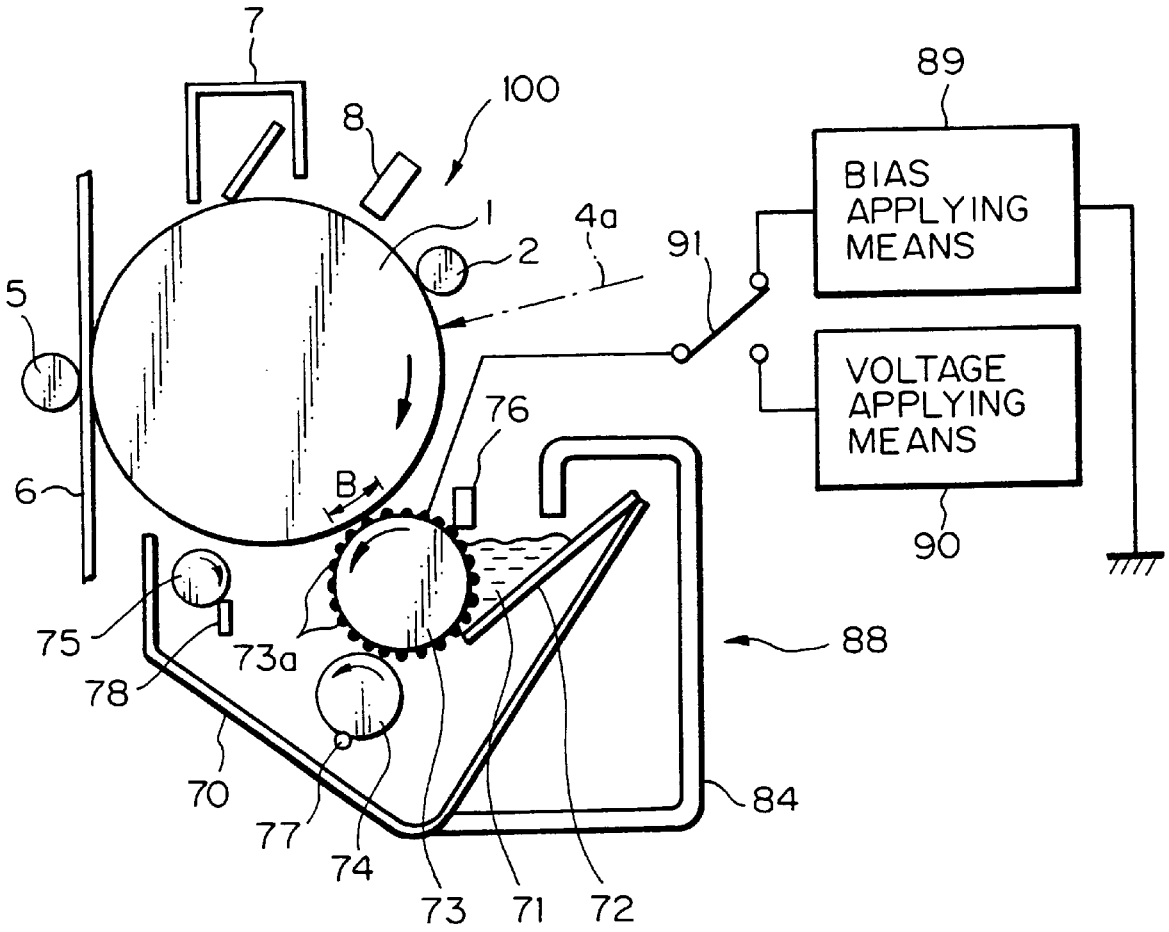

FIG. 16 shows a wet developing device representative of a ninth embodiment of the present invention. As shown, a developing device, generally 88, has voltage applying means 90 in place of the liquid replenishing means 79. The voltage applying means 90 applies between the drum 1 and the developing roller 73 a voltage (different from the usual bias for development) sufficient for the developing liquid 71 held between the lugs 73*a* to contact the drum 1. A switch 91 selectively connects the voltage applying means 90 or bias applying means 89 to the developing roller 73. The negative side of the voltage applying means 90 and bias applying means 89 and the base of the drum 1 are connected to ground. As for the rest of the construction, this embodiment is identical with the previous embodiments.

In operation, the developing roller 73 in rotation conveys the developing liquid 71 toward the drum 1 while holding it between its lugs 73*a*. When the switch 91 is operated to connect the voltage applying means 89 to the developing roller 73, the voltage different from the usual bias is applied between the drum 1 and the roller 73. As a result, the liquid 71 implemented as a thin layer and controlled by the height of the lugs 73*a* is allowed to separate from the roller 73 and uniformly contact the drum 1.

The above voltage different from the usual bias for development is one higher than the usual bias without regard to the polarity and sufficient for the developing liquid 71 between the lugs 73*a* to contact the drum 1. Stated another way, the voltage is one sufficient for the liquid 71 on the developing roller 71 to rise toward the drum 1 and fill the developing position where the drum 1 and roller 73 face each other over the preselected nip width B. Even when the liquid 71 is held in uniform contact with the drum 1, the toner of the liquid 71 is attracted toward the drum 1 by electrophoresis. Just after this, the switch 91 is operated to apply the usual bias for development from the bias applying means 89 to the developing roller 73 in place of the above voltage.

The voltage applying means 90 is driven for a preselected period of time from the time just before the start of image formation. This minimizes the duration of the application of the voltage and thereby saves power.

An embodiment to be described hereinafter is implemented as a copier of the type including a wet developing device for developing a latent image by feeding a developing liquid of high toner content from a developer carrier to the latent image. In this type of copier, a developer regulating member is spaced from the developer carrier by a preselected distance and forms a thin layer of developing liquid of high toner content on the developer carrier. An electric field is formed between the developer carrier and the regulating means such that the toner particles contained in the developing liquid fed to a gap between them migrate toward the surface of the developer carrier by electrophoresis. Alternatively, the embodiment to be described is implemented as a copier including a wet developing device for forming a thin layer of developing liquid of high toner content on a developer carrier and causing the developer layer to contact the surface of an image carrier in order to develop a latent image formed on the image carrier. In this alternative type of copier, after the developer layer has been formed on the developer carrier, but before the developer carrier contacts the image carrier, toner particles contained in the developer carrier are caused to cohere. In this case, the developer carrier is formed with a number of lugs on its circumferential surface for retaining the developer.

10th Embodiment

This embodiment is basically constructed and operated in the same meaner as the first embodiment shown in FIG. 1. The same structural elements as the elements shown in FIG. 1 are designated by like reference numerals, and a detailed description thereof will not be made in order to avoid redundancy.

Figure 17:
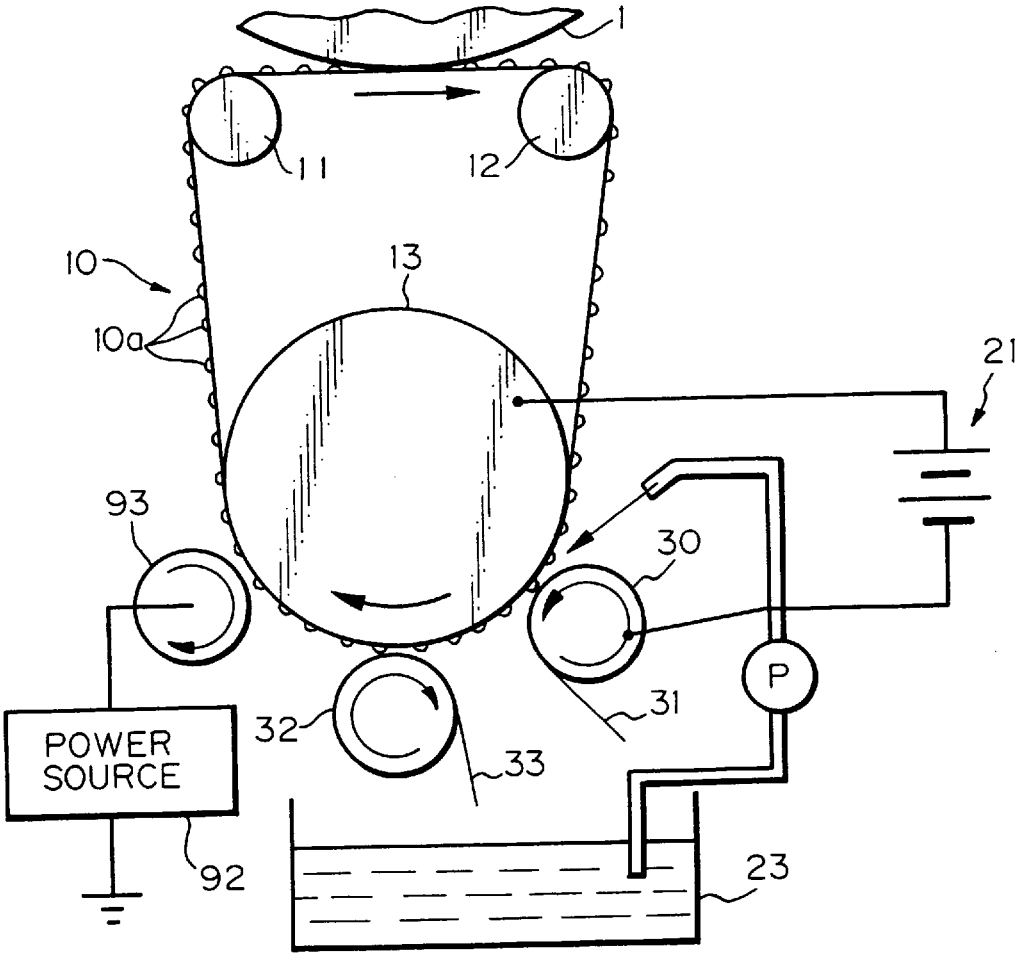

FIG. 17 shows a developing device representative of the tenth embodiment. As shown, this embodiment, like the second embodiment, includes the electrode roller or developer regulating means 30 and reverse roller or excess liquid removing means 32. A non-contact discharge member 93 is located downstream of the reverse roller 32 and implemented as a rotatable conductive roller. The discharge member 93 is spaced from the developer layer formed on the belt 10 and plays the role of means for causing the toner particles of the developer to cohere. A preselected voltage for causing the toner particles to cohere is applied from a power source 92 to the discharge member 93.

The belt 10 is formed with a number of lugs 10*a* on its outer periphery. The lugs 10*a* are identical in size, number and configuration as the lugs 73*a* formed on the developing member 73 included in the seventh to ninth embodiments. The developing layer formed on the belt 10 has a thickness greater than the height of the lugs 10*a*. The thickness of the developer layer is adjusted on the basis of the rotation speed of the reverse roller 32 and the gap between the roller 32 and the belt 10.

Figure 18:
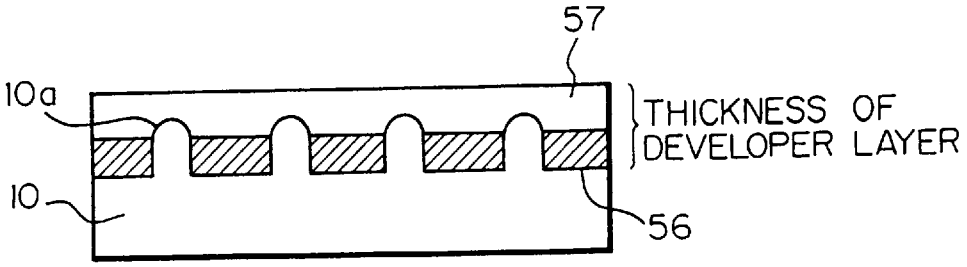
FIG. 18 shows a developer layer formed on a developing belt included in the tenth embodiment.

FIG. 18 shows the developer layer formed on the part of the belt 10 moved away from the reverse roller 32. As shown, a high toner content developer layer 56 is formed in the vicinity of the surface layer of the belt 10 by the electrode roller 30. In this layer 56, toner particles migrated toward the belt 10 due to electrophoresis gather. A low toner content developer layer 57 overlies the above layer 56; the toner content sequentially decreases with an increase in distance from the surface layer of the belt 10. The boundary between the developer layers 56 and 57 is not clear, but is assumed to be in a condition shown in FIG. 19.

Figure 19:
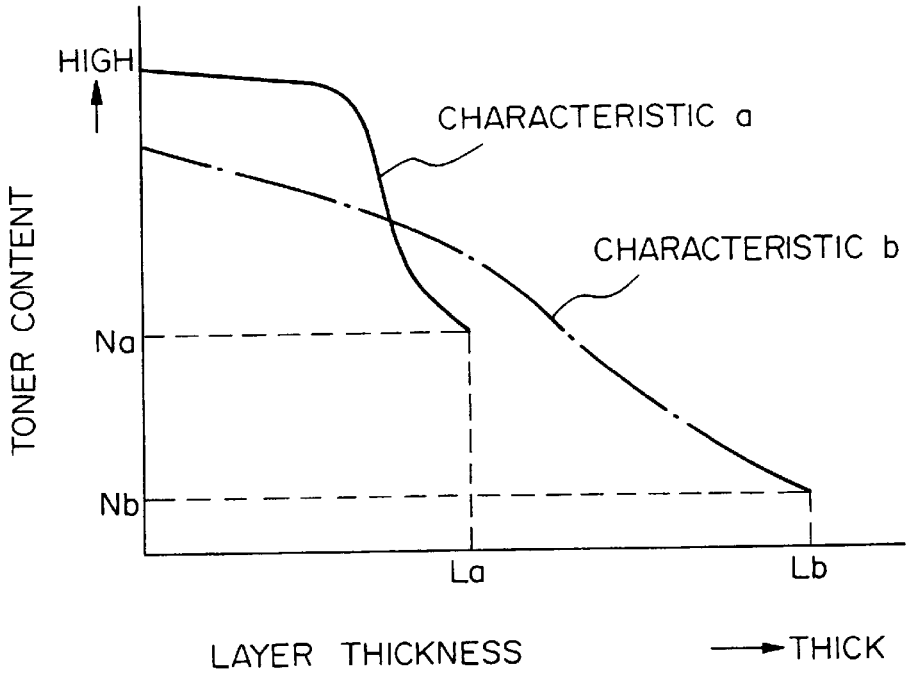
FIGS. 19, 20, 21 and 22 each shows a particular characteristic of the tenth embodiment.

In FIG. 19, the ordinate indicates the toner distribution in the developer layer (solid content) while the abscissa indicates the thickness of the developer layer as measured from the flat portion of the belt 10. Characteristic curves a and b each is derived from a particular distance between the electrode roller 30 and the belt 10, a particular voltage applied to the roller 30, and a particular toner content of the developing liquid. For example, the curves a and b are respectively derived from a developing liquid having a relatively high toner content and a developing liquid having a relative low toner content. La and Lb are representative of the thicknesses of the developer layer. So long as the developer layer has a high toner content, a sufficient image density is available on a paper even if the layer is thin; however, the toner content of the surface portion of the thin developer layer is as high as Na. When the toner content is low, the toner content of the surface portion of the developer layer is as low as Nb although the thickness may increase. For example, when the toner content of the surface potion is relatively high, as represented by the curve a, the developer contaminates the background of the drum 1. To eliminate the this problem, use is made of the prewetting liquid stated earlier. This kind of liquid allows the thin developer layer whose toner content is not high to contact the drum 1, thereby obviating background contamination. With the thin developer layer having the low toner content Nb, background contamination is not noticeable despited that the developer layer contacts the drum 1. In this case, the roller for applying the prewetting liquid shown in FIG. 1 is omissible.

To provide the developer layer with the thickness greater than the height of the lugs 10*a*, it is desirable that the conditions represented by the curve b in FIG. 19 be set up.

Figure 20:
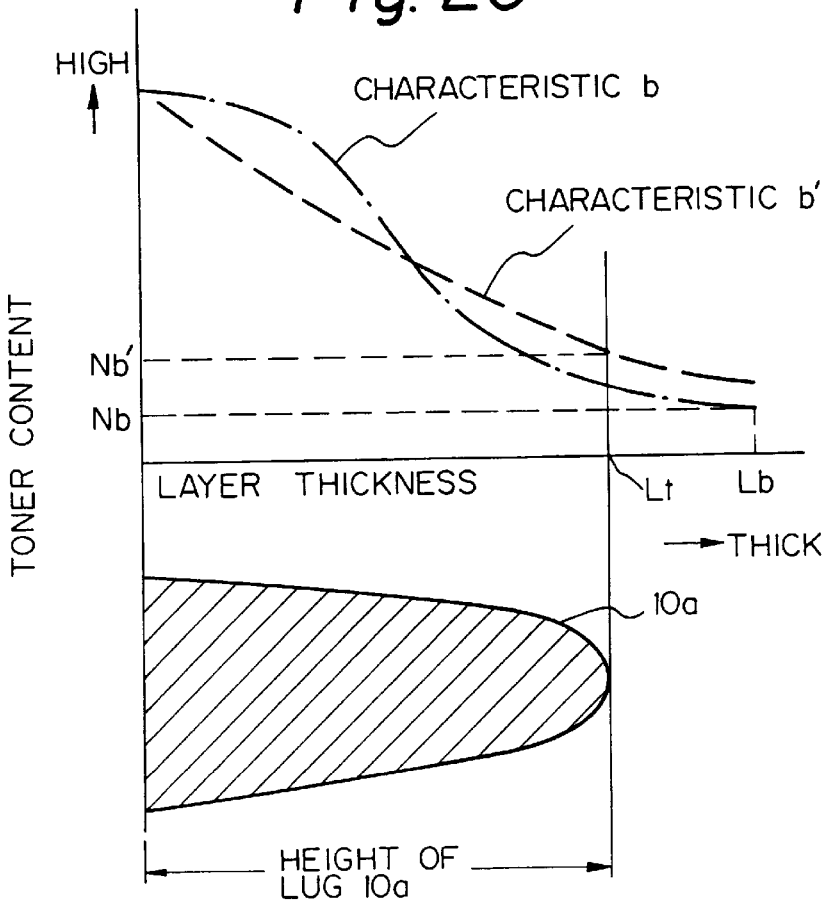

FIG. 20 shows a relation between the height of the lugs 10*a* and the toner content distribution of the thin developer layer. As shown, the developer layer is provided with the thickness Lb and frees the drum 1 from background contamination even when its surface portion contacts the drum 1. In FIG. 20, one of the lugs 10*a* is shown in a section and indicated by hatching. The lugs 10*a* are so dimensioned as to be buried in the developer layer having the thickness Lb. The toner density distribution and the thickness of the developer layer are adjusted such that the developer layer on the tips of the projections 10*a* does not contaminate the background of the drum 1.

In the illustrative embodiment, the tips 10*a* of the lugs 10 contact the surface of the drum 1, guaranteeing the gap between the belt 10 and the drum 1. In the developing region, the drum 1 and the surface portion of the developer layer presumably contact each other and disturb the toner particles existing in the developer layer. Presumably, therefore, at a position before the developing position, the characteristic b is replaced with a characteristic b', and the toner content around the tip of the lug 10*a* is Nb'. To protect the toner content from such disturbance, the discharge member 93 is caused to effect glow discharge or corona discharge. Consequently, the surface portion of the developer layer is allowed to contact the drum 1 after the cohesion of the toner particles has been enhanced.

Figure 21:
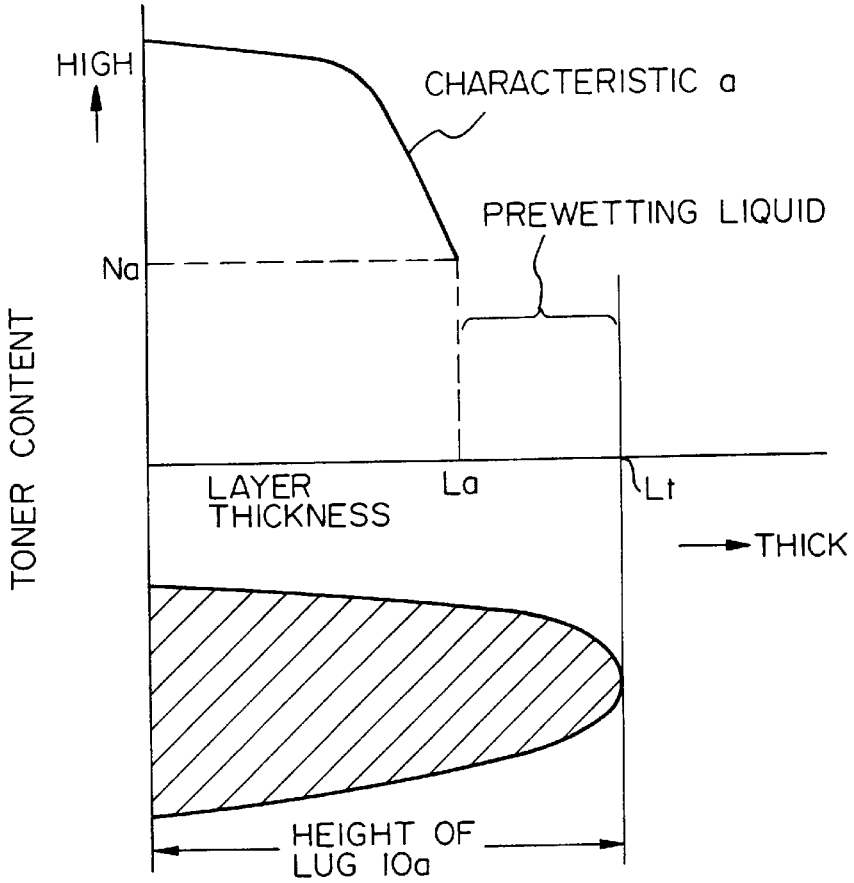
Figure 22:
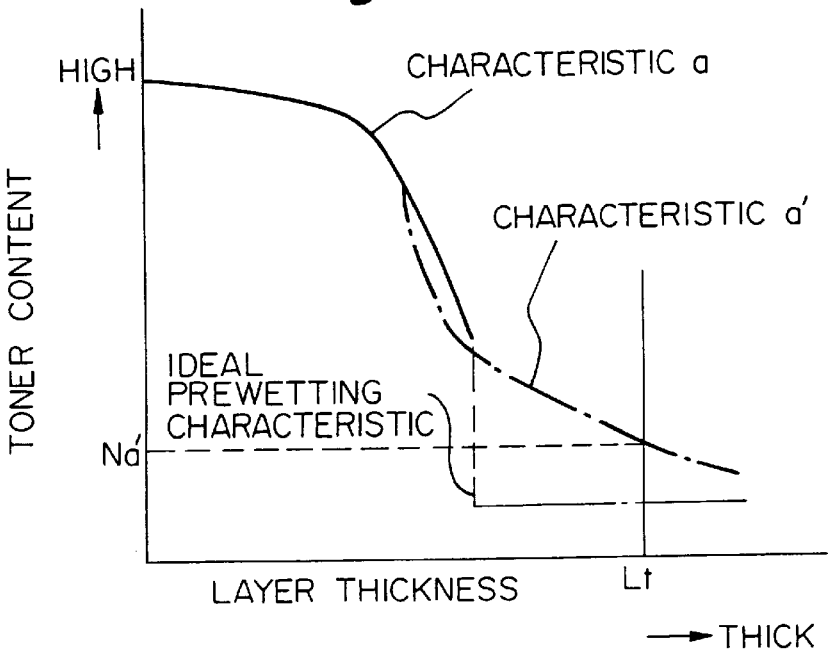

Even with the characteristic a shown in FIG. 19, the disturbance to the toner particles of the developer layer presumably occurs at the developing position. This will be described with reference to FIGS. 21 and 22. FIG. 21 shows a relation between the characteristic a and the height of the lugs 10*a*. In accordance with the characteristic a, the lugs 10*a* have a height Lt greater than the thickness La of the developer layer. The distance between La and Lt is filled with the prewetting liquid. In FIG. 22, the toner content of the developing liquid derived from the characteristic a and the toner content of the same derived from the ideal contact condition of the presetting liquid are respectively indicated by a solid Line and a dash-and-dot line. In practice, however, when the drum 1, the surface layer of the developer layer and the prewetting liquid contact, the toner particles in the developer layer are presumably disturbed, as stated earlier. As a result, the characteristic a is replaced with the characteristic a'. This causes the developer layer to contact the drum 1 with a toner content Na' and contaminate the background of the drum 1.

Even with the characteristic a, it is preferable to cause the discharge member 93 to effect glow discharge or corona discharge in order to enhance the cohesion of the toner particles. This effectively suppresses the migration of the toner particles in the background area at the developing position. In this condition, the developer layer on the belt 10 is ought into contact with the drum 1 to which the prewetting liquid has been applied or after the prewetting liquid has been further applied to the developer layer on the belt 10. In any case, the developer layer is allowed to contact the drum 1 with the intermediary of the prewetting liquid and therefore protects its tone particles from disturbance.

In the illustrative embodiment, the height Ht of the lugs 10*a* should preferably be 10 μm to 40 μm, more preferably 10 μm to 20 μm. The thickness Lb of the developer layer should preferably be 5 μm to 30 μm greater than the height Lt. In the case of FIG. 21, the thickness La of the developer layer should preferably be 5 μm to 60 μm smaller thin the height Lt. The minimum Lt and minimum La are 10 μm and 5 μm, respectively. The maximum Lt and maximum La are 100 μm and 40 μm, respectively.

With either one of the characteristics shown in FIGS. 20 and 21, it is possible to enhance the cohesion of the toner particles with the discharge member 93 and to reduce the height Lt and thicknesses La and Lb. This is because the cohesion of the toner particles reduces the toner content Na or Nb of the surface portion of the developer layer and thereby obviates background contamination.

In the illustrative embodiment, the lugs 10*a* of the belt 10 contact the surface of the drum 1, guaranteeing the gap between the surface of the drum 1 and the flat portion of the belt 10. Therefore, a pressure to act on the developer layer when the developer layer and drum 1 contact each other is reduced, compared to the case wherein the peripheral surface of the belt 10*a* is simply flat. It follows that irregularity in the thickness of the developer layer and the disturbance to the developer layer ascribable to the above pressure are reduced. This successfully obviates irregularity in image density and background contamination. Further, when the prewetting layer is fed to the surface of the drum 1 or the developer layer formed on the belt 10, the prewetting liquid and developing liquid are scarcely mixed together despite the above pressure. Consequently, even when the two liquids are different in characteristic, they can be readily separated from each other for reuse in the developing device.

Moreover, because the developer layer has a thickness greater than the height of the lugs 10*a*, an image free from background contamination is attainable without resorting to the prewetting liquid. The copier without the prewetting liquid applying device is simple and low cost.

In summary, it will be seen that the present invention provides an image forming apparatus and a wet developing device therefore having various unprecedented advantages, as enumerated below.

(1) A developing layer is deposited on a developer carrier in the form of a uniform layer having a high toner content, ensuring high, quality images free from irregularity.

(2) An excess developing liquid having a low toner content and present in the surface portion of the above developer layer can be removed by a simple device. This further increases the toner content of the developer layer.

(3) The excess developing liquid is removed by a roller held in contact with the surface of the developer carrier. This, coupled with the fact that an electric field for preventing toner particles from depositing on the surface of the roller is formed between the roller and the developer carrier, allows the excess developing liquid to be efficiently removed.

(4) The excess developing liquid is physically collected by a roller spaced from the surface of the developer carrier. By moving the surface of the roller at a higher speed than the surface of the developer carrier, it is possible to remove a great amount of excess developing liquid. This further increases the toner content of the uniform developer layer.

(5) Toner particles in the developer carrier formed on the developer carrier are caused to cohere, further increasing the toner content of the developer layer. This can be done with a simple arrangement. Particularly, the removal of the excess developing liquid can be executed at the same time as the cohesion of the toner particles.

(6) Developer regulating means is rotatable. By varying the moving speed of the surface of the developer regulating means, it is possible to control the thickness of the developer layer of high toner content formed on the developer carrier. Therefore, the thickness of the developer layer to be fed to the image carrier, i.e., the image density can be controlled.

(7) When the developer regulating member is implemented as a belt, the regulating member faces the developer carrier over a broad area. This further enhances the efficient formation of the uniform developer layer of high toner content with a simple configuration.

(8) Even if the developing liquid has a low viscosity, the thickness of the developer layer varies little when irregularity in contact pressure occurs on the contact of the developer layer with the image carrier. As a result, irregularity in the amount of developer to be fed to the image carrier and ascribable to irregularity in contact pressure is reduced, so that a stable image is achievable. In addition, even when the contact pressure is high, the thickness of the developer layer varies little. This ensures a margin as to the setting of the contact pressure.

(9) Charging for balancing the stabilization. of the thickness of the developer layer and the developing efficiency can be delicately adjusted The above two factors can therefore be balanced with ease.

(10) The thickness of the developer is so regulated as to obviate excessive toner deposition, i.e., image contamination ascribable to an excessive developer layer thickness and irregularity in solid image ascribable to a short developer layer thickness.

(11) A rotatable developing member is formed with a number of lugs on its circumferential surface. The thin developer layer controlled by the height of the lugs is brought into uniform contact with the image carrier, so that the toner particles of the developer layer can migrate toward a latent image due to electrophoresis. Therefore, an attractive solid image implemented by continuous dots or an attractive thin line image can be produced without any dot lost.

(12) Liquid replenishing means is implemented as a liquid replenishing device for replenishing a liquid from a storage to the developing member. While a developing liquid consists at least of a carrier liquid and toner, an additive is generally added to the liquid in order to maintain the polarity of the toner or to enhance the fixing ability of the toner, varying the toner content or solid content of the liquid. However, the liquid replenishing device is capable of forcibly replenishing even a liquid having a high solid content. The liquid can therefore be selected from a broad range of liquids.

(13) The liquid replenishing means replenishes the liquid for a preselected period of time from the time just before the start of image formation. Therefore, the replenishment is executed only during a minimum necessary period for development. This obviates the excessive replenishment of the liquid which would result in contamination.

(14) The liquid replenishing means replenishes the liquid either continuously or intermittently in accordance with the density of a latent image pattern formed on the image carrier. Therefore, the liquid can be replenished to the developing position at a timing corresponding to the pitch of the latent image formed on the image carrier. This also obviates the excessive replenishment of the liquid.

(15) Voltage applying means is driven for a preselected period of time from a time just before the start of image formation. This allows the voltage to be applied only for a minimum necessary period of time when the developer layer is brought into contact with the image carrier, thereby saving power.

(16) Lugs formed on the developing member have at least their tip portions contacting the image carrier insulated. This prevents the latent image formed on the image carrier from leaking via the lugs.

(17) A discharge body is located in the vicinity of the surface of the image carrier. The discharge body collects the carrier liquid of the developing liquid applied to the image carrier and enhances the cohesion of toner particles to deposit on the image carrier. Therefore, even when the toner particles deposited on the image carrier arc pressed by a paper or similar recording medium, they are faithfully transferred to the paper without being crushed.

Various modifications will become possible for those skilled in the art after receiving the teachings of the present disclosure without departing from the scope thereof.

What is claimed is:

1. An image forming apparatus for developing a latent image electrostatically formed on an image carrier by feeding a developing liquid having a high toner content to the latent image, said apparatus comprising:

a developer carrier for carrying the developing liquid thereon; and developer regulating means facing, but spaced from, said developer carrier for causing the developing liquid to form a thin developer layer on said developer carrier;

wherein an electric field is formed between said developer carrier and said developer regulating means for causing toner particles of the developing liquid fed to a gap between said developer carrier and said developer regulating means to migrate toward a surface of said developer carrier due to electrophoresis, to thereby form a developer layer of a relatively high solid content and an excess developing liquid surface layer;

wherein the excess developing liquid surface layer is removed without contacting the developer carrier such that the developing liquid fed to said gap has a density of less than 10 wt % inclusive in terms of a solid content.

2. An apparatus as claimed in claim 1, wherein said developer regulating means comprises a conductive rotatable roller.

3. An apparatus as claimed in claim 1, wherein said developer regulating means comprises a conductive belt.

4. An apparatus as claimed in claim 1, wherein said developer regulating means comprises a conductive electrode plate.

5. An apparatus as claimed in claim 1, further comprising excess liquid removing means for removing the excess developing liquid surface layer from said developer layer after said developer layer has been formed by said developer regulating means, but before said developer lays contacts said image carrier.

6. An apparatus as claimed in claim 5, wherein said excess liquid removing means comprises a nozzle for jetting air.

7. An apparatus as claimed in claim 5, wherein said excess liquid removing means comprises a rotatable roller contacting said developer carrier and having a surface moved at a same speed as a surface of said developer carrier, wherein an electric field for preventing the developing liquid from depositing on said surface of said rotatable roller is formed between said rotatable roller and said developer carrier.

8. An apparatus as claimed in claim 5, wherein said excess liquid removing means comprises a squeeze roller facing, but spaced from, said developer carrier.

9. An apparatus as claimed in claim 5, further comprising cohering means for causing the toner particles existing in said developer layer to cohere after said developer layer has been formed on said developer carrier by said developer regulating means, but before said developer layer contacts said image carrier.

10. An apparatus as claimed in claim 9, wherein said cohering means comprises a discharge member not contacting said developer layer present on said developer carrier.

11. An apparatus as claimed in claim 9, wherein said cohering means comprises a rotatable roller contacting said developer layer present on said developer carrier and having a surface moved at a same speed as a surface of said developer carrier, and wherein a voltage for causing discharge to occur on said surface of said rotatable roller is applied to said rotatable roller.

12. An apparatus as claimed in claim 9, wherein said developer regulating means comprises a conductive rotatable roller.

13. An apparatus as claimed in claim 9, wherein said developer regulating means comprises a conductive belt.

14. An apparatus as claimed in claim 9, wherein said developer regulating means comprises a conductive electrode plate.

15. An apparatus as claimed in claim 5, wherein said developer regulating means comprises a conductive rotatable roller.

16. An apparatus as claimed in claim 5, wherein said developer regulating means comprises a conductive belt.

17. An apparatus as claimed in claim 5, wherein said developer regulating means comprises a conductive electrode plate.

18. An apparatus as claimed in claim 1, further comprising cohering means for causing the toner particles existing in said developer layer to cohere after said developer layer has been formed on said developer carrier by said developer regulating means, but before said developer layer contacts said image carrier.

19. An apparatus as claimed in claim 18 wherein said cohering means comprises a discharge member not contacting said developer layer present on said developer carrier.

20. An apparatus as claimed in claim 18, wherein said cohering means comprises a rotatable roller contacting said developer layer present on said developer carrier and having a surface moved at a same speed as a surface of said developer carrier, wherein a voltage for causing discharge to occur on said surface of said rotatable roller is applied to said rotatable roller.

21. An apparatus as claimed in claim 18, wherein said developer regulating means comprises a conductive rotatable roller.

22. An apparatus as claimed in claim 18, wherein said developer regulating means comprises a conductive belt.

23. An apparatus as claimed in claim 18, wherein said developer regulating means comprises a conductive electrode plate.

24. An apparatus as claimed in claim 1, wherein said developer regulating means comprises a conductive rotatable roller.

25. An apparatus as claimed in claim 1, wherein said developer regulating means comprises a conductive belt.

26. An apparatus as claimed in claim 1, wherein said developer regulating means comprises a conductive electrode plate.

27. An apparatus as claimed in claim 1, wherein said developer carrier is formed with a number of lugs on an outer periphery thereof for feeding the developing liquid to said image carrier while retaining the developing liquid between said number of lugs.

28. An apparatus as claimed in claim 27, wherein said developer layer has a thickness greater than a height of said lugs.

29. An image forming method comprising the steps of:

forming a latent image electrostatically on an image carrier;

feeding a dense developing liquid, having a density of less than 10 wt % inclusive in terms of a solid content, from a developer carrier to said image carrier;

forming a dense developer layer of a relatively high solid content and an excess developing liquid surface layer on said developer carrier; and further increasing a density of said dense developer layer formed on said developer carrier by removing said excess developing liquid surface layer without contacting said developer carrier.

30. In an image forming apparatus for depositing a dense developing liquid, having a density of less than 10 wt % inclusive in terms of solid content, on a developer carrier in a form of a thin developer layer by forming developing liquid on said developer carrier, forming an excess liquid surface layer on said developing liquid, and removing said excess liquid surface layer without contacting said developer carrier to form said developer layer, and causing said developer layer to contact a surface on an image carrier to thereby develop a latent image electrostatically formed on said surface, toner particles contained in said developer layer are caused to cohere after said developer layer has been formed on said developer carrier, but before said developer layer contacts said image carrier.

31. An apparatus as claimed in claim 30, wherein a discharge member is located in the vicinity of, but spaced from, said developer layer, said discharge member causing the toner particles to cohere by discharging.

32. An apparatus as claimed in claim 31, wherein a thickness of said developer layer formed on said developer carrier is regulated in order to obviate contamination of an image due to excessive toner deposition ascribable to an excessive thickness and irregularity in a solid image ascribable to a short thickness.

33. An apparatus as claimed in claim 31, wherein said charge member effects glow discharge or discharge of a degree causing pulseless corona to occur.

34. An apparatus as claimed in claim 33, wherein a thickness of said developer layer formed on said developer carrier is regulated in order to obviate contamination of an image due to excessive toner deposition ascribable to an excessive thickness and irregularity in a solid image ascribable to a short thickness.

35. An apparatus as claimed in claim 30, wherein a thickness of said developer layer formed on said developer carrier is regulated in order to obviate contamination of an image due to excessive toner deposition ascribable to an excessive thickness and irregularity in a solid image ascribable to a short thickness.

36. An apparatus as claimed in claim 30, wherein said developer car is formed with a number of lugs on an outer periphery thereof for feeding the developing liquid to said image carrier while retaining the developing liquid between said number of lugs.

37. An apparatus as claimed in claim 36, wherein said developer layer has a thickness greater than a height of said lugs.

38. An image forming apparatus for developing a latent image electrostatically formed on an image carrier by feeding a developing liquid having a high toner content to the latent image, said apparatus comprising:

a developer carrier for carrying the developing liquid thereon; and developer regulating means, comprising a conductive belt, facing, but spaced from, said developer carrier for causing the developing liquid to form a thin developer layer on said developer carrier;

wherein an electric field is formed between said developer carrier and said developer regulating means for causing toner particles of the developing liquid fed to a gap between said developer carrier and said developer regulating means to migrate toward a surface of said developer carrier due to electrophoresis.

39. An apparatus as claimed in claim 38, wherein the developing liquid fed to said gap has a density of less than 10 wt % inclusive in terms of a solid content.

40. An apparatus as claimed in claim 38, further comprising excess liquid removing means for removing an excess developing liquid from said developer layer after said developer layer has been formed by said developer regulating means, but before said developer layer contacts said image carrier.

41. An apparatus as claimed in claim 40, wherein said excess liquid removing means comprises a nozzle for jetting air.

42. An apparatus as claimed in claim 40, wherein said excess liquid removing means comprises a rotatable roller contacting said developer carrier and having a surface moved at a same speed as a surface of said developer carrier, wherein an electric field for preventing the developer liquid from depositing on said surface of said rotatable roller is formed between said rotatable roller and said developer carrier.

43. An apparatus as claimed in claim 40, wherein said excess liquid removing means comprises a squeeze roller facing, but spaced from, said developer carrier.

44. An apparatus as claimed in claim 40, further comprising cohering means for causing the toner particles existing in said developer layer to cohere after said developer layer has been formed on said developer carrier by said developer regulating means, but before said developer layer contacts said image carrier.

45. An apparatus as claimed in claim 44, wherein said cohering means comprises a discharge member not contacting said developer layer present on said developer carrier.

46. An apparatus as claimed in claim 44, wherein said cohering means comprises a rotatable roller contacting said developer layer present on said developer carrier and having a surface moved at a same speed as a surface of said developer carrier, and wherein a voltage for causing discharge to occur on said surface of said rotatable roller is applied to said rotatable roller.

47. An apparatus as claimed in claim 38, wherein said developer carrier is formed with a number of lugs on an outer periphery thereof for feeding the developing liquid to said image carrier while retaining the developing liquid between said number of lugs.

48. An apparatus as claimed in claim 47, wherein said developer layer has a thickness greater than a height of said lugs.

49. An image forming apparatus for developing a latent image electrostatically formed on an image carrier by feeding a developing liquid having a high toner content to the latent image, said apparatus comprising:

a developer carrier for carrying the developing liquid thereon;

developer regulating means facing, but spaced from, said developer carrier for causing the developing liquid to form a thin developer layer on said developer carrier; and excess liquid removing means for removing an excess developing liquid from said developer layer after said developer layer has been formed by said developer regulating means, but before said developer layer contacts said image carrier, wherein said excess liquid removing means comprises a nozzle for jetting air;

wherein an electric field is formed between said developer carrier and said developer regulating means for causing toner particles of the developing liquid fed to a gap between said developer carrier and said developer regulating means to migrate toward a surface of said developer carrier due to electrophoresis.

50. An image forming apparatus for developing a latent image electrostatically formed on an image carrier by feeding a developing liquid having a high toner content to the latent image, said apparatus comprising:

a developer carrier for carrying the developing liquid thereon;

developer regulating means facing, but spaced from, said developer carrier for causing the developing liquid to form a thin developer layer on said developer carrier; and excess liquid removing means for removing an excess developing liquid from said developer layer after said developer layer has been formed by said developer regulating means, but before said developer layer contacts said image carrier, wherein said excess liquid removing means comprises a rotatable roller contacting said developer carrier and having a surface moved at a same speed as a surface of said developer carrier, wherein an electric field for preventing the developing liquid from depositing on said surface of said rotatable roller is formed between said rotatable roller and said developer carrier;

wherein an electric field is formed between said developer carrier and said developer regulating means for causing toner particles of the developing liquid fed to a gap between said developer carrier and said developer regulating means to migrate toward a surface of said developer carrier due to electrophoresis.

51. An image forming apparatus for developing a latent image electrostatically formed on an image carrier by feeding a developing liquid having a high toner content to the latent image, said apparatus comprising:

a developer carrier for carrying the developing liquid thereon;

developer regulating means facing, but spaced from, said developer carrier for causing the developing liquid to form a thin developer layer on said developer carrier; and excess liquid removing means for removing an excess developing liquid from said developer layer after said developer layer has been formed by said developer regulating means, but before said developer layer contacts said image carrier, wherein said excess liquid removing means comprises a squeeze roller facing, but spaced from, said developer carrier;

wherein an electric field is formed between said developer carrier and said developer regulating means for causing toner particles of the developing liquid fed to a gap between said developer carrier and said developer regulating means to migrate toward a surface of said developer carrier due to electrophoresis.

* * * * *